US009399545B2

(12) United States Patent
Ha et al.

(10) Patent No.: US 9,399,545 B2
(45) **Date of Patent: *Jul. 26, 2016**

(54) MODULAR PACKAGE

(71) Applicant: Braun GmbH, Kronberg (DE)

(72) Inventors: Thinh Nguyen Ha, Cincinnati, OH (US); Martin Jay Marotti, Carmel, IL (US); Hauke Schormair, Griesheim (DE); Manfred Bruno Kobbe, Frankfurt am Main (DE)

(73) Assignee: BRAUN GMBH, Kronberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/875,814

(22) Filed: May 2, 2013

(65) Prior Publication Data

US 2013/0313155 A1 Nov. 28, 2013

Related U.S. Application Data

(60) Provisional application No. 61/644,110, filed on May 8, 2012, provisional application No. 61/644,008, filed on May 8, 2012, provisional application No. 61/644,006, filed on May 8, 2012.

(51) Int. Cl.
*B65D 85/00* (2006.01)
*B65D 75/22* (2006.01)
(Continued)

(52) U.S. Cl.
CPC ..... *B65D 85/00* (2013.01); *B65D 5/009* (2013.01); *B65D 5/4204* (2013.01); *B65D 75/225* (2013.01); *B65D 77/042* (2013.01); *B65D 2585/6845* (2013.01)

(58) Field of Classification Search
CPC ..... A45D 2200/053; A46B 15/0091; B65D 21/062; B65D 75/002; B65D 5/4204; B65D 75/225; B65D 85/00; B65D 2101/0038; B65D 2517/5083; B65D 21/0202; B65D 75/24; B65D 75/327; B65D 75/323; B65D 2203/02
USPC ..... 220/23.88, 4.22, 23.83, 270, 4.26–4.27; 206/228, 525, 747, 15.2, 362, 362.4, 206/349, 351–360, 362.1, 471, 361, 362.2, 206/362.3, 15.3, 701, 461, 467, 469, 745, 206/748, 750; 229/203
See application file for complete search history.

(56) References Cited

U.S. PATENT DOCUMENTS 968,286 A * 8/1910 Streit ..... 229/131.1
1,249,499 A * 12/1917 Rice ..... 229/203
(Continued)

FOREIGN PATENT DOCUMENTS

EP 2196169A11 6/2010
FR 2873103 1/2006
(Continued)

OTHER PUBLICATIONS

International Search Report and Written Opinion for Z-8670Q dated Sep. 2, 2013, 7 pages.

*Primary Examiner* — Anthony Stashick
*Assistant Examiner* — James M Van Buskirk
(74) *Attorney, Agent, or Firm* — James E. Oehlenschlager

(57) ABSTRACT

A modular package having a container encompassing two or more modules, one of which includes a personal article visible from the outside of the modular package. The container includes a window making the personal article visible to a consumer.

5 Claims, 23 Drawing Sheets

(51) Int. Cl.

| | |
|---|---|
| ***B65D 77/04*** | (2006.01) |
| ***B65D 5/00*** | (2006.01) |
| ***B65D 5/42*** | (2006.01) |

(56) References Cited

U.S. PATENT DOCUMENTS

| | | | | | |
|---|---|---|---|---|---|
| 2,112,062 | A | * | 3/1938 | Berger | 206/747 |
| 2,681,141 | A | | 6/1954 | Young | |
| 2,878,929 | A | * | 3/1959 | Leupold | 206/494 |
| 3,536,247 | A | | 10/1970 | Gadiel | |
| 3,776,375 | A | | 12/1973 | Rohdin | |
| 3,990,578 | A | | 11/1976 | Roeser | |
| 4,013,214 | A | | 3/1977 | Hansen | |
| 4,752,029 | A | | 6/1988 | Buford | |
| 4,825,624 | A | | 5/1989 | Calcerano | |
| 4,884,718 | A | | 12/1989 | Leahy | |
| 4,951,812 | A | * | 8/1990 | Chen | 206/748 |
| 4,998,616 | A | * | 3/1991 | Hillinger | 206/748 |
| 5,029,705 | A | | 7/1991 | Schmidt et al. | |
| 5,158,175 | A | | 10/1992 | Crawford | |
| 5,178,282 | A | | 1/1993 | Williams | |
| 5,249,670 | A | * | 10/1993 | Simon | 206/773 |
| 5,311,996 | A | | 5/1994 | Duffy et al. | |
| 5,405,005 | A | | 4/1995 | White | |
| 5,447,233 | A | | 9/1995 | Smith | |
| 5,485,919 | A | | 1/1996 | Samber et al. | |
| 5,497,894 | A | | 3/1996 | Krupa et al. | |
| 5,564,569 | A | | 10/1996 | Kiefer | |
| 6,059,106 | A | | 5/2000 | Baker et al. | |
| 6,729,475 | B2 | | 5/2004 | Yuhas et al. | |
| 6,923,365 | B2 | | 8/2005 | Auclair et al. | |
| 7,178,311 | B2 | | 2/2007 | Hoogland | |
| 7,213,709 | B2 | | 5/2007 | Moskovich et al. | |
| 7,320,406 | B2 | | 1/2008 | Auclair | |
| 7,427,011 | B2 | | 9/2008 | Auclair et al. | |
| 7,611,042 | B2 | | 11/2009 | Bates et al. | |
| 7,845,519 | B2 | | 12/2010 | Newberry et al. | |
| 7,886,905 | B2 | | 2/2011 | Kamada | |
| 7,922,070 | B2 | | 4/2011 | Auclair | |
| 8,245,844 | B2 | * | 8/2012 | Sorrentino et al. | 206/362.1 |
| 2004/0195195 | A1 | | 10/2004 | Mason | |
| 2005/0051459 | A1 | | 3/2005 | Casanova | |
| 2005/0087464 | A1 | | 4/2005 | Brattesani et al. | |
| 2010/0230312 | A1 | * | 9/2010 | Sorrentino et al. | 206/369 |
| 2011/0042375 | A1 | | 2/2011 | Jones et al. | |
| 2011/0073596 | A1 | | 3/2011 | Chang | |
| 2011/0100845 | A1 | | 5/2011 | Meech et al. | |
| 2011/0147391 | A1 | | 6/2011 | Corder et al. | |
| 2011/0198348 | A1 | | 8/2011 | Marbe et al. | |
| 2011/0210163 | A1 | | 9/2011 | Clark et al. | |

FOREIGN PATENT DOCUMENTS

| | | |
|---|---|---|
| GB | 2096574 | 10/1982 |
| WO | WO 2010/065029 A1 | 6/2010 |

* cited by examiner

MODULAR PACKAGE

FIELD OF THE INVENTION

The invention relates to modular packages comprising individual modules encompassed within a container, such as a box or sleeve.

BACKGROUND OF THE INVENTION

Prior packaging systems have used individual packaging size dimensions depending on the product and the accessories packaged with the product. For example powered toothbrush packages will often differ in size depending on the type of powered toothbrush and the number of accessories packaged with the toothbrush. The use of individual packaging for each different toothbrush increases the cost as each toothbrush sold has its own package that cannot be used with another toothbrush. Further this means the packaged accessories sold with one toothbrush cannot be used with another toothbrush as the packaging differs.

In addition prior art packaging involves the use of "clam-shell" packaging to display products. Clam-shell packaging is frequently used in the powered toothbrush industry as clam-shells are often made of a transparent plastic material that allows a consumer a 360° view of the toothbrush. Clam-shell packages suffer from at least two negatives: (1) clam-shell packages lack a flat base, meaning the package cannot stably rest on a store shelf without tipping over, and therefore must be hung from a shelf wall; and (2) clam-shell packages are formed from two opposing panels of rigid plastic that are sealed together, making the package difficult for a consumer to open.

What is needed is a packaging system that can be use interchangeable modules for different product and accessory combinations, and wherein the product can be displayed to a consumer using a modular package that is easy to access and can stably set on a store shelf.

SUMMARY OF THE INVENTION

A modular package is provided that comprises a top surface, bottom surface, and side surface; a container encompassing a first module and a second module, wherein the container comprises a window through which the personal article is visible to a consumer; a first module having three pairs of opposing panels defining an interior space; each panel having an exterior and interior surface; a top and base panel forming one pair of opposing panels; side panels forming two pairs of opposing panels; one of the side panels being a flap connected to an adjacent side panel by a fold line for forward and backward movement, allowing access to the interior space of the first package; and a second module comprising a personal article, wherein the personal article is visible to a consumer.

A modular package is provided that comprises a top surface, bottom surface, and side surface; a container encompassing a first module and a second transparent module, wherein the container comprises a window through which the personal article is visible to a consumer; a first module having three pairs of opposing panels defining an interior space; each panel having an exterior and interior surface; a top and base panel forming one pair of opposing panels; side panels forming two pairs of opposing panels; one of the side panels being a flap connected to an adjacent side panel by a fold line for forward and backward movement, allowing access to the interior space of the first package; and a second transparent module comprising a personal article, wherein the personal article is visible to a consumer.

DETAILED DESCRIPTION OF THE INVENTION

The invention comprises a modular package having two or more individual modules enclosed within a container, such as a box or sleeve, with at least one of the modules containing one or more personal articles. The modular packages are displayed at the point of sale, such as store shelves or pictured on the internet. The individual modules that make up a modular package can be in the form of a box and can be in any configuration, for example, modules can be stacked, with one on top of the other within one modular package, but when assembled within the container will have a substantially uniform height. A modular package may even contain two or more modules stacked together, adjacent to a single module having substantially the same height as the height of the stacked modules. In certain embodiments one or more of the modules may have a window so the contents of the module can be viewed. In certain embodiments, one or more of the modules may be formed from a transparent or translucent material, such as plastic, so the content can be visible.

The personal articles contained within a module may include powered razors, manual razors, powered toothbrushes, powered toothbrush components, and powered toothbrush accessories; manual toothbrushes; oral care products—for example: dentifrice gels and powders, rinse, and floss; personal hygiene consumables—for example: rinses, shampoos, conditioners, lotions; household goods, such as blenders and mixers; or combinations thereof.

Figure 1:
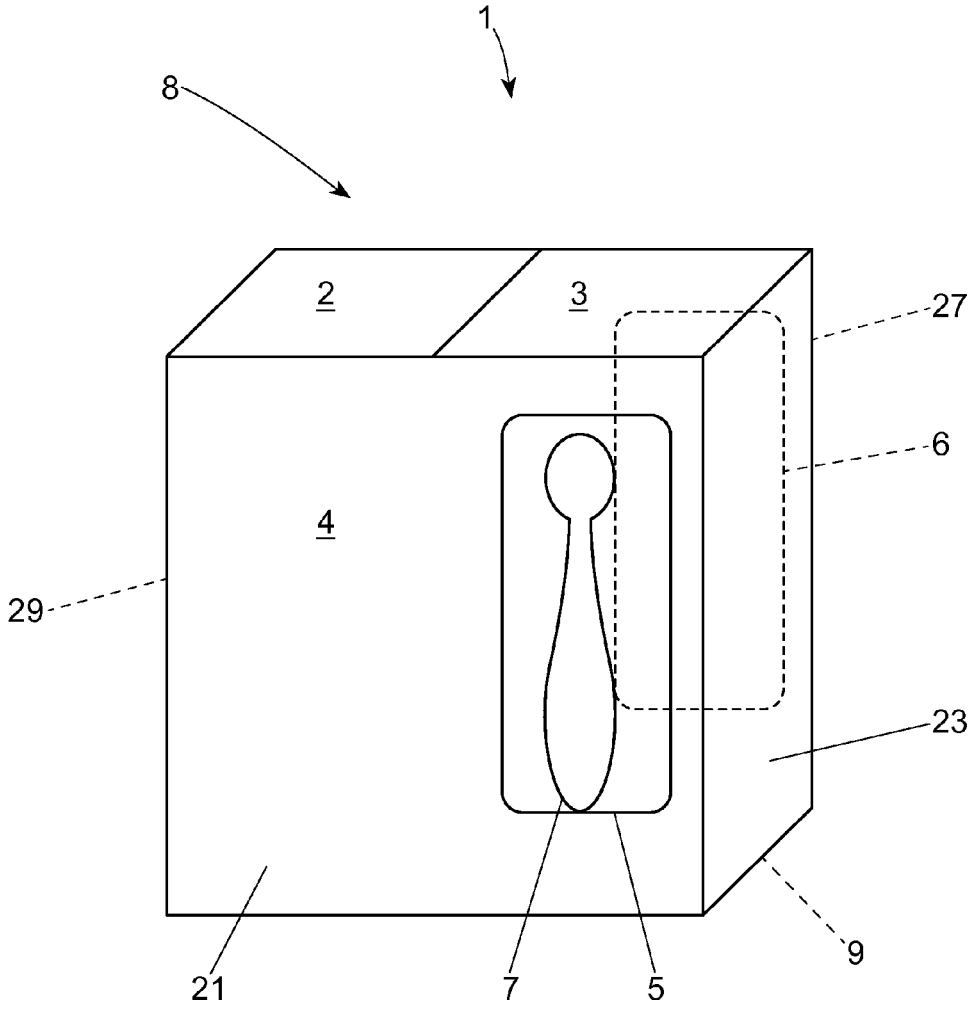
FIG. 1 shows a perspective view of a modular package according to an embodiment of the present invention.
Figure 1A:
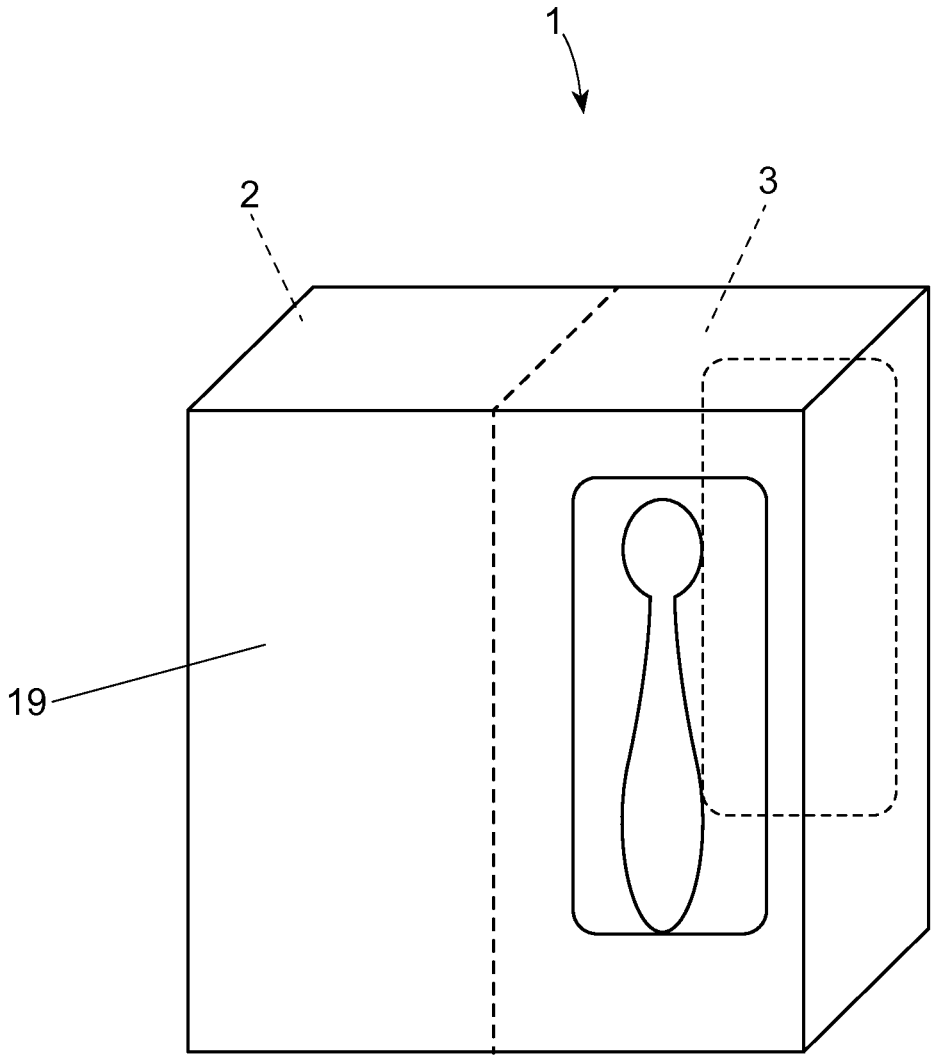
FIG. 1A shows a perspective view of a modular package according to an embodiment of the present invention.
Figure 1B:
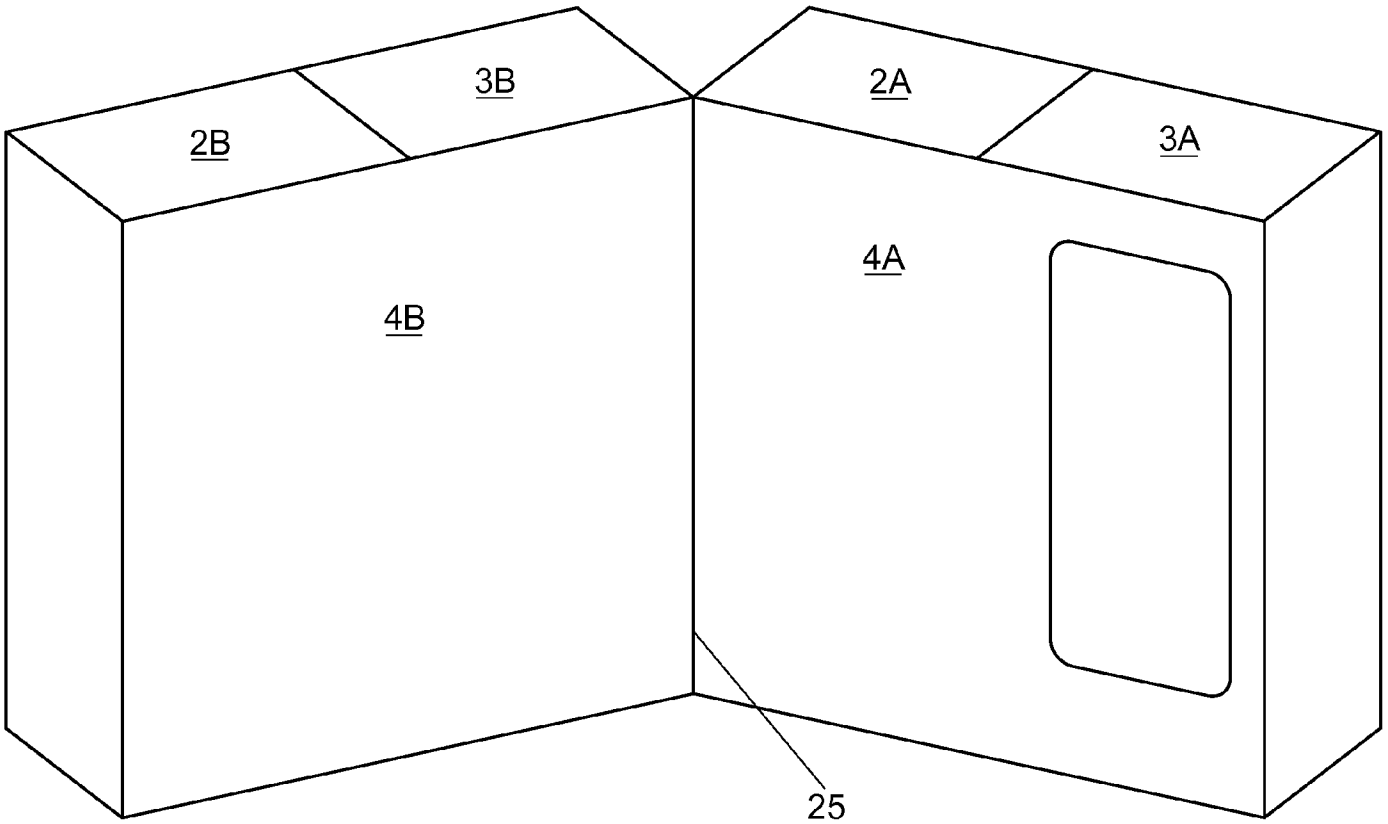
FIG. 1B shows a perspective view of a modular package according to an embodiment of the present invention.

As shown in FIG. 1 the modular package 1 of the present invention comprises two or more modules, in this embodiment two boxes 2, 3, encompassed within a sleeve 4. In other embodiments, as shown in FIG. 1A a modular package 1 may comprise two or more modules, such as two boxes 2, 3 encompassed within an outer box 19. In still further embodiments, as shown in FIG. 1B, two sleeves 4A, 4B (each encompassing two boxes 2A, 3A and 2B, 3B) may be connected along a fold line 25, such that the individual sleeves 4A, 4B may fold towards or away from each other like a book. With reference back to FIG. 1 the modular package comprises a top surface 8, bottom surface 9, and a side surface, which as shown in FIG. 1 may be comprised of four side sections 21, 23, 27, 29 in a rectangular or square cross-sectional shape. In certain embodiments the sleeve 4 substantially covers the side surface 21, 23, 27, 29 of the modular package 1, leaving the modular package 1 open at the top 8 and bottom 9 surfaces. Wherein the top and bottom surfaces of a modular package are determined by how the modular package will be oriented when displayed to a consumer. The boxes 2, 3 are arranged within the inner volume of the sleeve 4. For each modular package a sleeve (or box) will have a defined inner volume in which individual modules will be contained. The inner volume of a sleeve (or box) is determined by the height, width and depth of the sleeve (or box).

Figure 2:
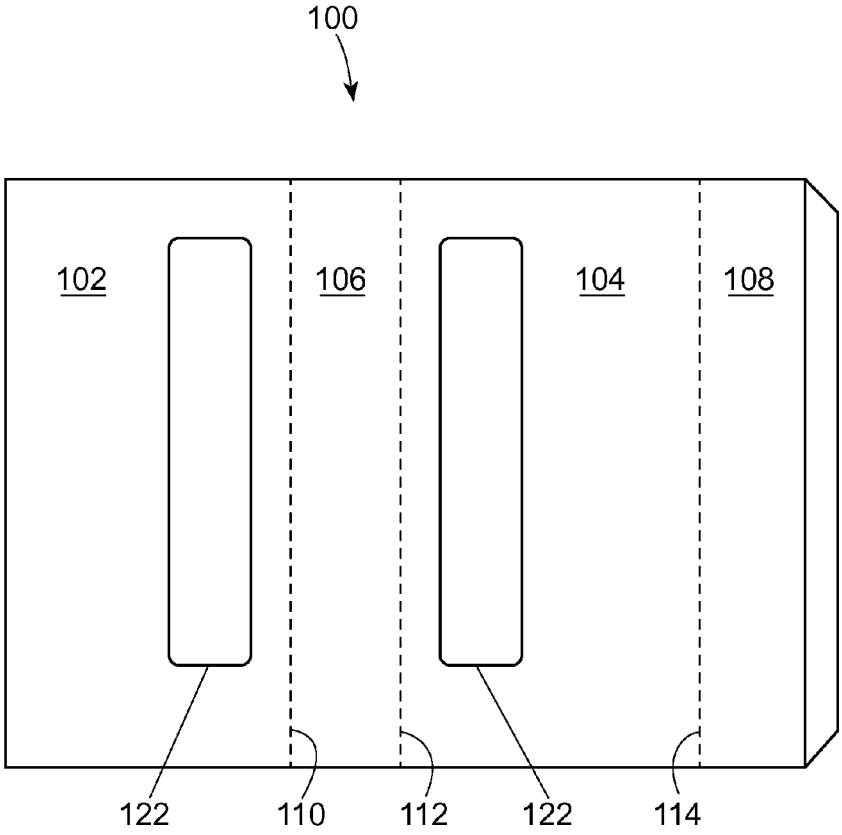
FIG. 2 shows a blank for forming a sleeve according to an embodiment of the present invention.
Figure 3:
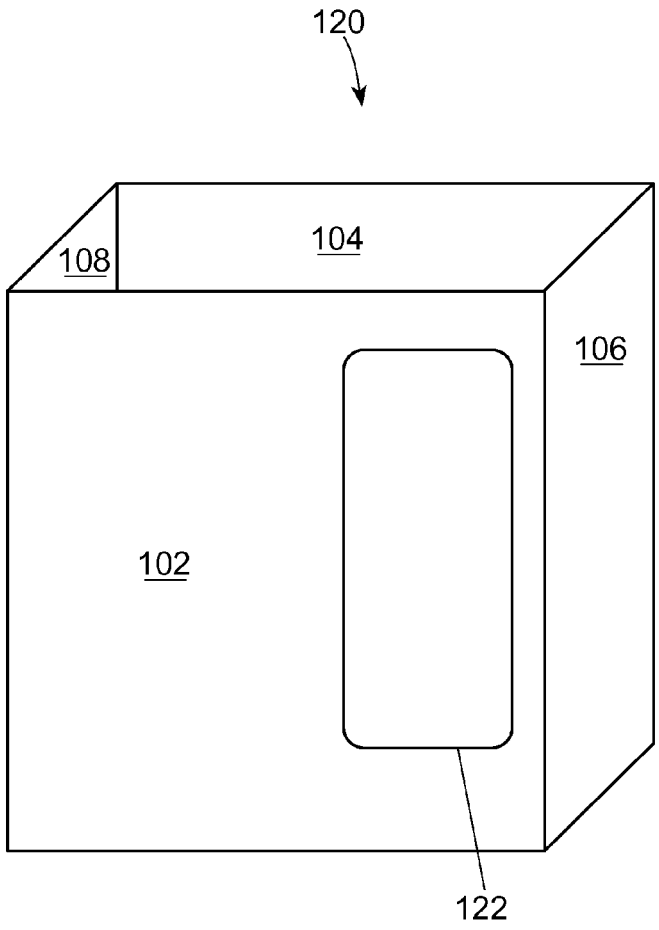
FIG. 3 shows a perspective view of a sleeve according to an embodiment of the present invention.

The containers encompassing modules may be produced from blanks, for example a sleeve blank as shown in FIG. 2. A sleeve blank 100 may include a front panel 102, back panel 104, and two side panels 106, 108. The panels are hinged one to the next in series along fold lines 110, 112 and 114. A sleeve 120, as shown in FIG. 3 may have one or more windows 122, such as one or more regions of transparency. As used herein, "transparency" means having the property of transmitting light without substantial scattering so that items lying beyond can be visible to a person. The window can comprise a transparent covering, such as, for example, a transparent film. In addition, or alternatively, the window can comprise an opening in the sleeve that does not include a covering. In certain embodiments, the window can comprise a transparent covering that can be clear, translucent, tinted or opaque. The transparent covering can be tinted in any suitable color or combination of colors. The transparent covering can also, or alternatively, be printed or embossed. In certain embodiments, the window can be images that depict or give the perception of a window, such as, images that depict a region of transparency or an opening.

Figure 4:
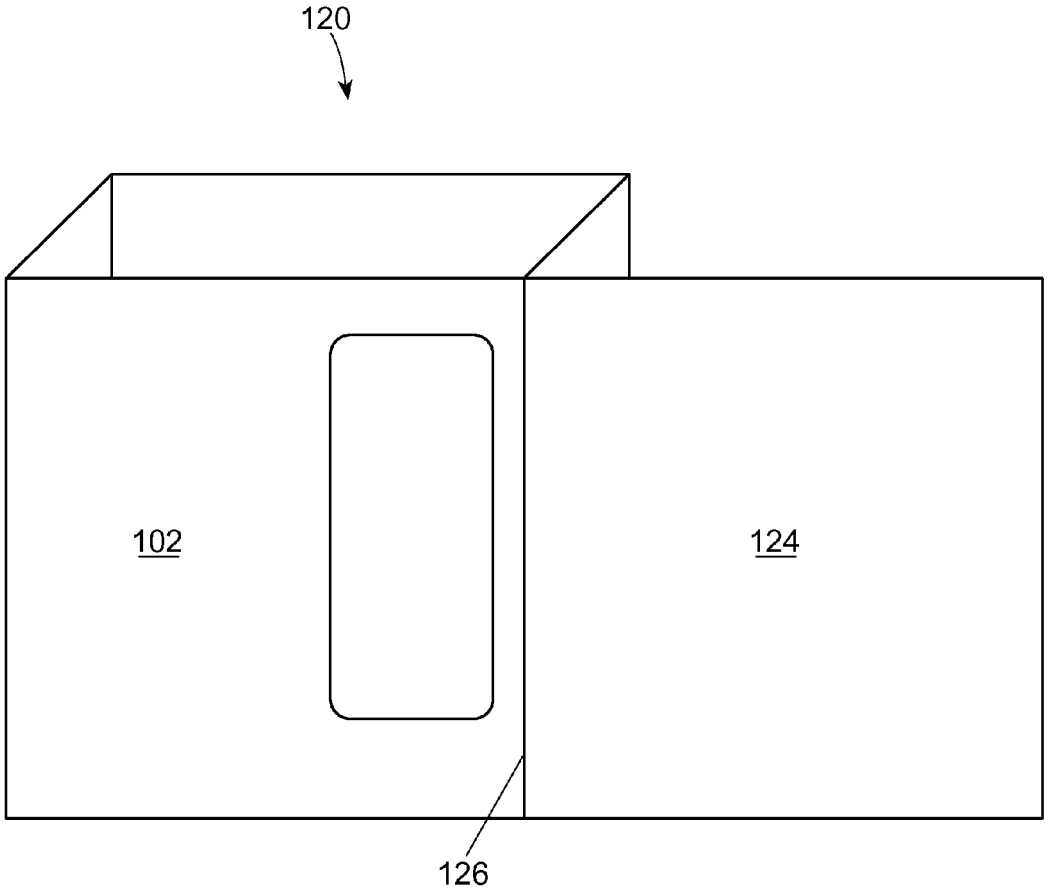
FIG. 4 shows a perspective view of a sleeve according to an embodiment of the present invention.

In addition, in certain embodiments, as shown in FIG. 4 a sleeve 120 may include a flap 124, wherein the flap is flexible about a hinge 126 such that it can be moved towards and away from the front panel 102 of the sleeve 120. A sleeve can be made of cardboard, paperboard, cartonboard, chipboard, plywood, SBS, metal, plastic, paper, card stock, fabric, ceramic, polymer, natural or synthetic fibers, webs, mesh, screen, wood, composite, mixtures or combinations thereof, or any other suitable material. A sleeve provides a modular package dimensional stability and allows for the easy removal of one sleeve and its replacement with another. As used herein, including the claims, the term "sleeve" means a hollow member having substantially fixed dimensions, for example as compared to a rubber band which has flexible dimensions, with at least one open end; and having any cross-sectional shape, including specifically but not exclusively, triangular, square, rectangular, pentagonal, hexagonal, heptagonal, octagonal and circular.

In certain embodiments a container, such as a sleeve or box may have dimensions of from about 250-260 mm in height, about 100-230 mm in width, and from about 50-230 mm in depth; in other embodiments a sleeve may have dimensions of from about 250-260 mm in height, about 100-180 mm in width, and from about 50-170 mm in depth.

As shown in FIG. 1 a sleeve 4 comprises at least one window 5 allowing the personal article to be viewed. In certain embodiments there are two or more windows in the sleeve allowing the personal article to be viewed from multiple angles within the modular package. The personal article, in this instance a powered toothbrush 7 can be viewed from the front window 5, back window 6, bottom, or top of the modular package 1—providing the module containing the powered toothbrush is transparent or translucent.

Figure 5:
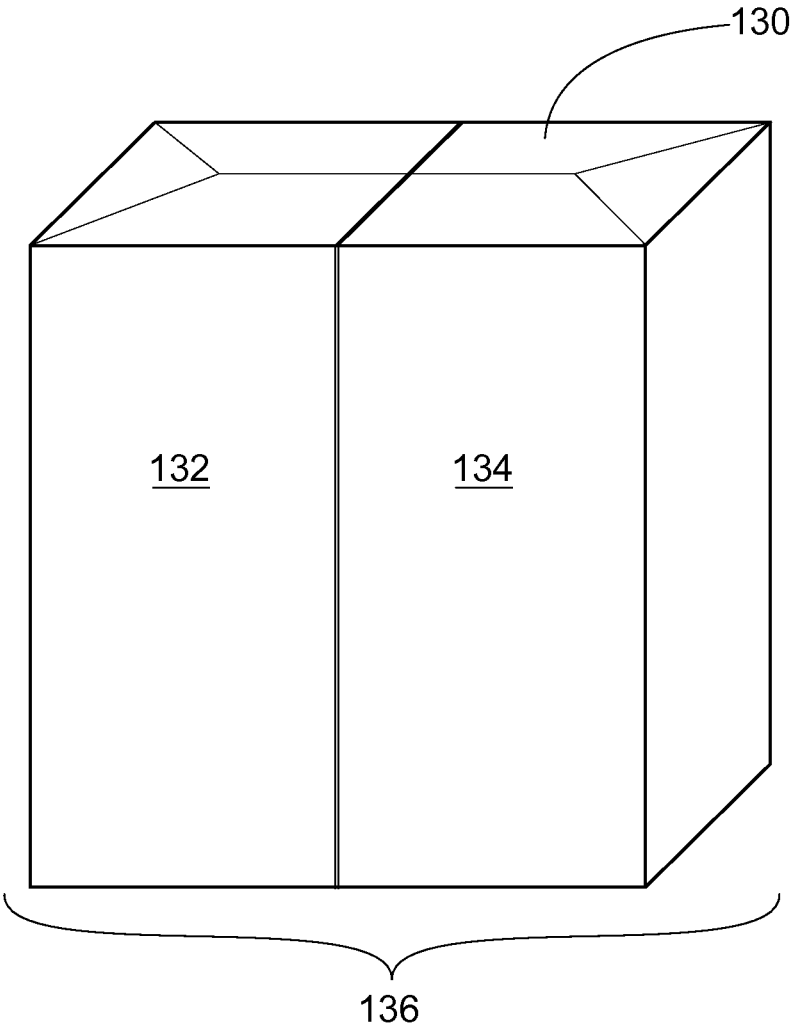
FIG. 5 shows a perspective view of a module group according to an embodiment of the present invention.

In addition to a container, as shown in FIG. 5 a plastic film cover 130 can be used, which surrounds, in certain embodiments completely, two or more modules 132, 134 forming a module group 136. The plastic film cover can be shrunk by heat treatment, which may provide dimensional stability. If the plastic film is tightened about a module group 136, for example by shrinking, so that the circumference of the plastic film is slightly smaller than the circumference of the module group 136, this method enables the plastic film cover 130 to surround the module group 136 with a tightening force. The tightening force can be varied depending on how tightly the film is shrunk about the module group 136. Shrinking can also be carried out in such a manner that the film cover surrounds the module group without a tightening force. Where a film wrap is used the tightening force can be achieved by wrapping, possibly in combination with shrinking, of the plastic film cover. The tightening force can provide additional dimensional stability to a module group by more tightly fixing the positions of the separate modules. A plastic film cover may include an opening mechanism such as a pull tab, tear strip, ribbon, perforation, or combinations thereof. The opening mechanism could be oriented vertically or horizontally on the module group. In certain embodiments the container would cover the opening mechanism.

A modular package may comprise a container, a module containing a personal article, and a second module containing personal article accessories, wherein both modules when combined substantially fill the inner volume of the container. This type of arrangement allows great flexibility, in that providing the modules have dimensions allowing them to fill the container in combination with other modules; modules can be freely exchanged to produce a modular package. Further, containers having the same or similar inner volume can be exchanged in a modular package providing great packaging diversity. For example, a module containing a powered toothbrush may be coupled with modules containing different loads of powered toothbrush accessories, provided that the modules have volumes that can fit into a container with the powered toothbrush module to produce a modular package.

In another example modular packages can use multiple containers having the same or similar inner volume.

The individual modules can be arranged in any manner—stacked, side-by-side, or any combination thereof providing the modules fit within the inner dimension of the container. The modules when finally assembled within the container should fill up most if not all of the inner space of a container, such that there is substantial contact between the outer surfaces of the modules and the inner space surface of the container—further the module height (either alone or stacked) should be substantially the same height of the container. However, in certain embodiments a sleeve height may be less than the module height. In addition as the individual module openings are covered by the container, the sleeve prevents the modules from being opened. In certain embodiments the average module height may be within about 2 cm of the container height in which the modules will be contained, in other embodiments 1 cm, in still other embodiments 0.5 cm. The individual modules contained within a container forming a modular package may have varying dimensions or the modules could have substantially similar dimensions.

Figure 6:
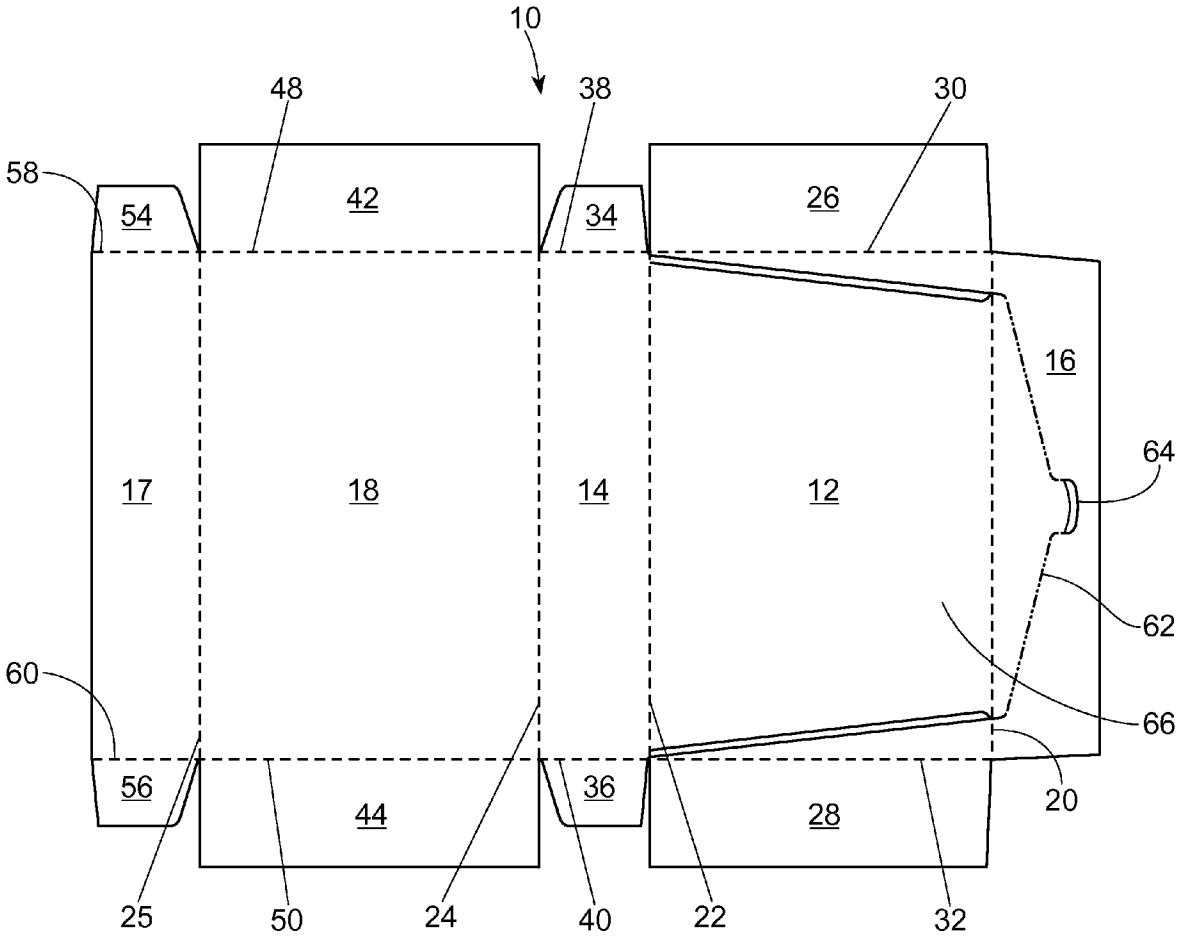
FIG. 6 shows a blank for forming a module according to an embodiment of the present invention.

A module of the present invention may be formed from a one-piece blank fabricated from paperboard, corrugated cardboard, or any other foldable sheet material. As shown in FIG. 6, in certain embodiments, a blank 10 comprises a series of main panels including a top panel 12, a first side panel 14, a second side panel 16, a third side panel 17, and a bottom panel 18. The main panels are hinged one to the next in series along fold lines 20, 22, 24 and 25. The blank 10 further comprises a series of end closure panels, hinged to opposing ends of each of the main panels for closing the ends of the module. The top panel 12 is hinged to a first and second closure panel 26, 28, along fold lines 30, 32. The first side panel 14 is in turn hinged to a first and second closure panel 34, 36 along fold lines 38, 40. And the bottom panel 18 is hinged to a first and second closure panel 42, 44 along fold lines 48, 50. The third side panel 17 is hinged to a first and second closure panel 54, 56 along fold lines 58, 60.

It will be recognized that as used herein, directional references such as "front", "back", "top", "bottom" and "side" do not limit the respective panels to such orientation, but merely serve to distinguish these panels from one another. Any reference to hinged connection should not be construed as necessarily referring to a single fold line only: in certain embodiments hinged connection can be formed from one or more of one of the following, a score line, a frangible line or a fold line, without departing from the scope of invention.

In certain embodiments the top panel 12 and second side panel 16 may form a closeable lid, which may include a first and second closure panel 26, 28, but which in certain embodiment one or both of the closure panels may be absent. Further, as shown in FIG. 6 in one or more embodiments the top panel 12, the second side panel 16, or both may be fabricated to have one or more lines of weakness 62. A line of weakness may comprise perforations, areas of thinness, cuts, voids, separations, or combinations thereof. A line of weakness may be shaped such that a notch 64 will be created upon separating the line of weakness 62 to produce a flap or module opening 66. Further, the top panel 12, second side panel 16, or both can be divided to produce two or more flaps.

Turning to the construction of a module 80 from a blank 10, a series of sequential folding steps, and in certain embodiments gluing operations, can be used, which can be performed in a straight line machine.

Figure 7:
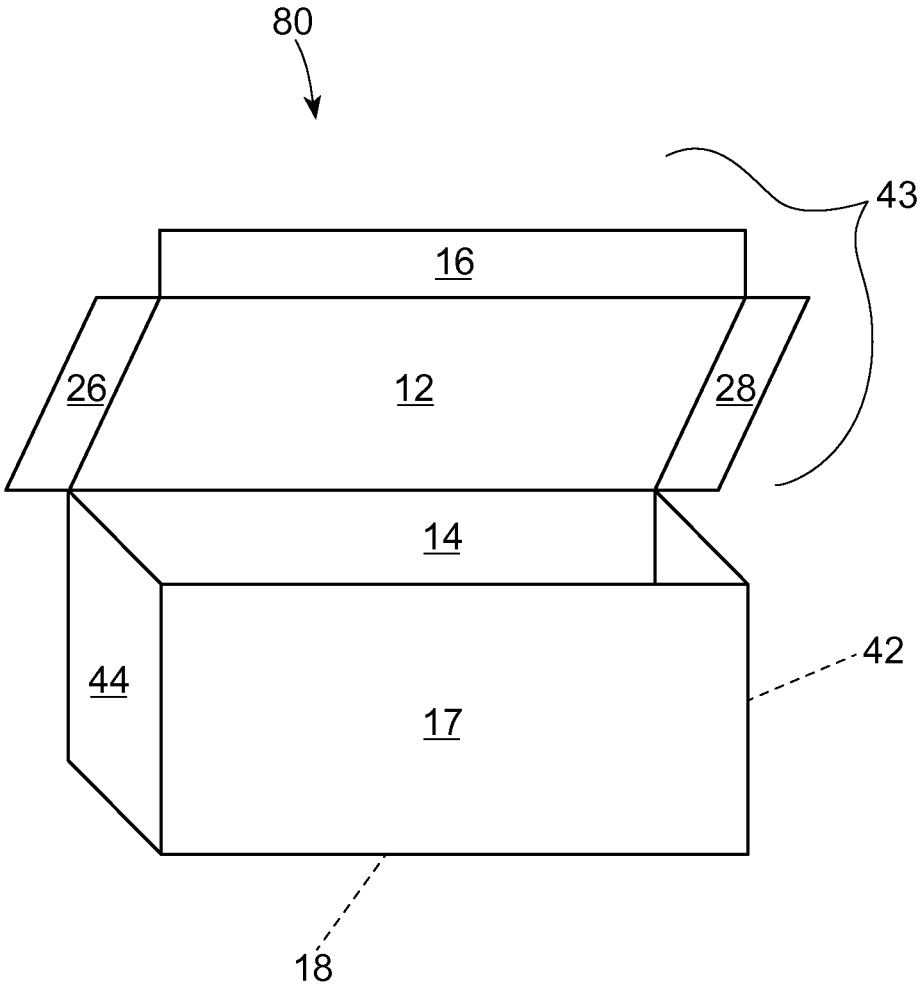
FIG. 7 shows a perspective view of a module according to an embodiment of the present invention.

A module 80, in certain embodiments, as shown in FIG. 7 comprises three pairs of opposing panels 12 and 18; 14 and 17; 42 and 44. The panels form the top 12, bottom 18, and sides 14, 17, 42, 44 of the module 80 and serve to define the exterior surface of the module 80 and the interior space. In certain embodiments an individual module does not have to be totally enclosed, for example a module could be a tray having an open or exposed side. The interior space of a module 80 may be accessed through an opening, such as a flap 43, wherein the flap comprises the top panel 12, second side panel, and the first and the first and second closure panel 26, 28, as shown in FIG. 7. A flap allows access to the interior space of a module and also generally includes some form of closure mechanism, such as a notch, tab, slot, or releasable adhesive to allow the flap to close and reseal the module. In certain embodiments the opening means of a module, for example a flap, will be positioned on the module such that the sleeve will serve as an extra securing means to keep the module closed.

Modules have dimensions such that the modules when stacked together will fill the inner volume of a container without either substantially protruding from an open end of the container or being so tight that the container is deformed. Modules can have differing dimensions as long as when combined to produce a module unit they substantially fill the container inner volume. In certain embodiments the module dimensions can differ by less than about 5%. In certain embodiments a module may have dimensions of from about 250-260 mm in height, about 50-70 mm in width, and from about 50-70 mm in depth; in other embodiments a container may have dimensions of from about 250-260 mm in height, about 100-120 mm in width, and from about 50-70 mm in depth.

In certain embodiments, a module can be made of relatively stiff materials, such as, for example, cardboard, paperboard, cartonboard, chipboard, plywood, SBS, metal, plastic, paper, card stock, fabric, ceramic, rigid foams—such expanded polystyrene, polymer, natural or synthetic fibers, webs, mesh, screen, wood, composite, mixtures or combinations thereof, or any other suitable material. Alternatively, or in addition, the module can be made of a flexible material, such as, blown or cast film in a blend of low density polyethylene and linear low density polyethylene, metallocenes, ethylene vinyl acetate, surlyn, polyethylene terephthalate, biaxally oriented polypropylene, nylon, combinations thereof, or any other suitable material.

A module can include at least one window, such as, a region of transparency. As used herein, "transparency" means having the property of transmitting light without substantial scattering so that items lying beyond can be visible to a person. The window can comprise a transparent covering, such as, for example, a transparent film. In addition, or alternatively, the window can comprise an opening in the module that does not include a covering. In certain embodiments, the window can comprise a transparent covering that can be clear, translucent, tinted or opaque. The transparent covering can be tinted in any suitable color or combination of colors. The transparent covering can also, or alternatively, be printed or embossed. In certain embodiments, the window can be images that depict or give the perception of a window, such as, images that depict a region of transparency or an opening.

In certain embodiments a first module will contain a personal article and a second module will contain the personal hygiene accessories, for example the first module may contain a powered toothbrush and the second module powered toothbrush accessories, such as instruction manual, charger, stand, travel case, brush heads, refills, refill tray, cup, instruction dvd, toothpaste, or mouth wash. In addition the personal hygiene accessories contained within a module may be packaged in a manner of use, such that the accessories used first would be positioned above the accessories that would normally be used afterward. For example, with powered toothbrush accessories the accessories could be packaged from top to bottom of the module, representing order of use, starting with instruction manual or dvd, stand, charger, brush heads, and refills The window can be disposed on at least one side of the module, such as, the front, the back, or sides. In certain embodiments, the window can be disposed on more than one side. The window can be at any location on the side and can comprise any appropriate amount of the module side, such as, for example, from about 5% to about 95% of the side, such as, for example, about 5% to about 75%, about 5% to about 50%, about 5% to about 25%, or any other amount of the side.

One of the modules may be a transparent module comprised of a transparent plastic. A transparent module may be used to contain a personal article, such that the device will be visible to a consumer through the transparent module. As used herein, "transparent" means having the property of transmitting light without substantial scattering so that items lying beyond can be visible to a person. The transparent plastic material can be clear, translucent, tinted or opaque. The transparent module can be tinted in any suitable color or combination of colors. The transparent module can also, or alternatively, be printed, embossed, or both. The transparent module can be formed of a plastic sheet material of sufficient thickness to be relatively rigid and self-supporting, as contrasted with the films employed in skin packaging. Although by no means intended as limiting, ordinarily such materials would have a minimum thickness of from 5 to 6 mils, although it may be possible in some applications to use even thinner sheets. Suitable plastics may be selected, for example, from among polymers and copolymers of ethylene, propylene, butene, and butadiene, polystyrenes, acetates, butyrates, propionates and vinyls, as well as others. If desired for added rigidity, the plastic sheet material may be ribbed or otherwise configured. The transparent module may also have a substantially flat base providing the transparent module with a tipping angle of greater than 11%.

Figure 8:
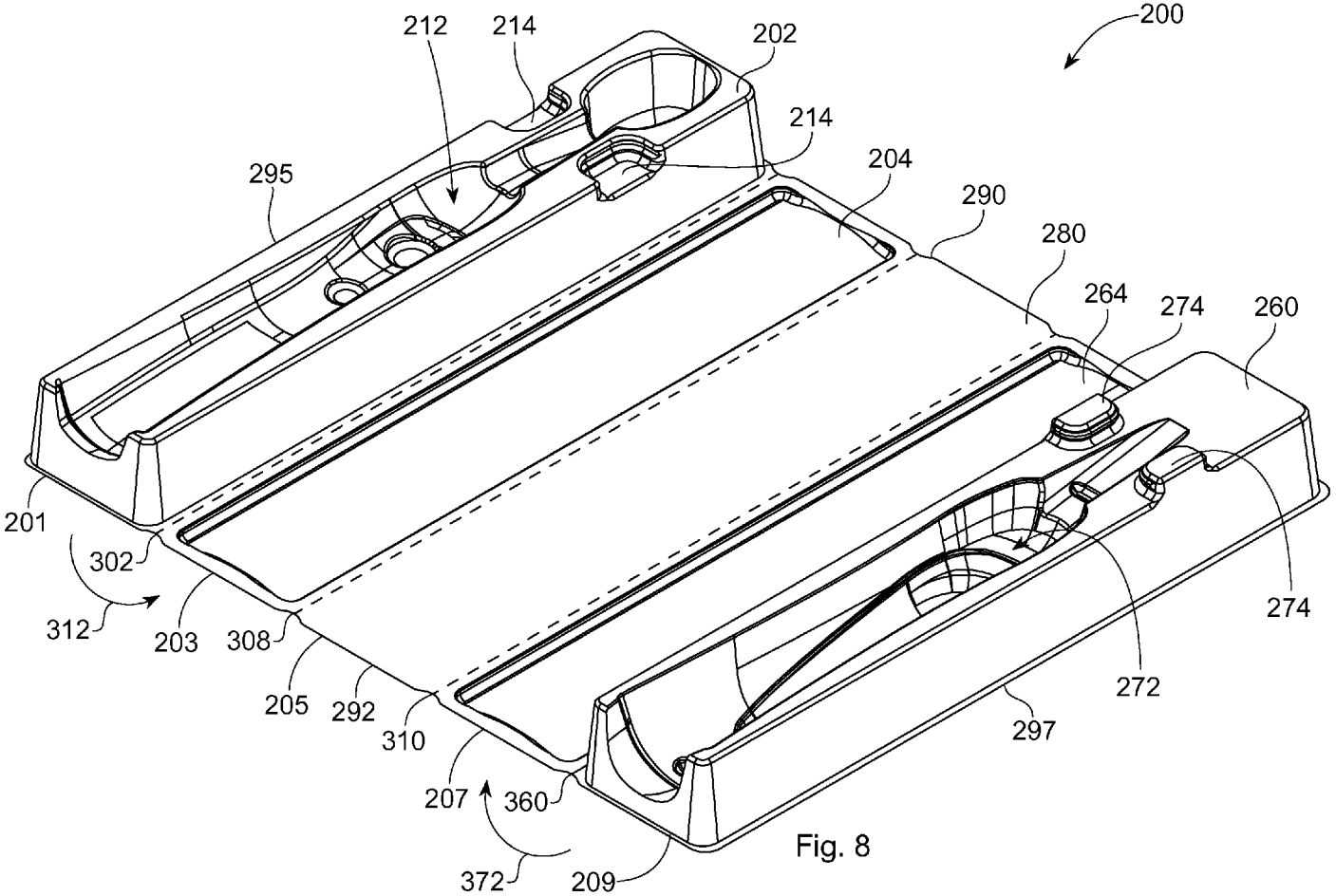
FIG. 8 shows a perspective view of an unfolded transparent module according to an embodiment of the present invention.

In certain embodiments for ease of packaging, a transparent module 200 may comprise a plurality of sections which may be folded with respect to one another. As shown in FIG. 8, the transparent module 200 may comprise a first section 202 having a recess 212 therein for receiving a portion of a personal article. Adjacent the first section 202, a first section cover 204 may be positioned. Opposite the first section 202, the transparent module 200 may comprise a second section 260 having a recess 272 therein for receiving a portion of the personal article. Adjacent the second section 260, a second section cover 264 may be positioned. Between the first section cover 204 and the second section cover 264, an eccentric cover 280 may be positioned.

As shown, the first section 202, the first section cover 204, the eccentric cover 280, the second section cover 264, and the second section 260 may be integrally joined with one another along hinged fold lines 302, 308, 310, 360. However, in certain embodiments the first section 202, the first section cover 204, the eccentric cover 280, the second section cover 264, or the second section 260 are discrete from one another. For example, the first section 202 and the first section cover 204 may be integrally formed, and the second section 260 and the second section cover 264 may be integrally formed. In such embodiments the eccentric cover 280 may be discrete and attached to the first section 202, the second section 260, the first section cover 204, or the second section cover 264. Additionally, in certain embodiments the transparent module 200 may not include the eccentric cover 280.

Still referring to FIG. 8, the first section 202 may comprise one or more receiving areas 214 while the second section 260 may include one or more engagement areas 274. When assembled, the engagement areas 274 engage the receiving areas 214. The outer surface of the engagement areas 274 may form an interference fit with the inner surface of the receiving areas 214 when brought into contact by the folding of the first 202 and second section 260. The interaction between the engagement areas 274 and the receiving areas 214 can help align the first section 202 and the second section 260. Additionally, the interference fit between the engagement areas 274 and the receiving areas 214 help maintain the transparent module in a closed position. Embodiments are contemplated where the first section 202 or the second section 260 comprise at least one engagement area 274 or at least one receiving area 214.

The engagement areas 274 or receiving areas 214 may be positioned in any suitable location. For example, engagement areas 274 or receiving areas 214 may be positioned adjacent a first edge 290 or an adjacent a second edge 292 of the transparent module 200. As another example, the engagement areas 274 or receiving areas 214 may be positioned adjacent lateral edges 295 and 297. As yet another example, the engagement areas 274 or receiving areas 214 may be positioned adjacent the first edge 290, the second edge 292, or adjacent lateral edges 295 and 297.

Figure 9:
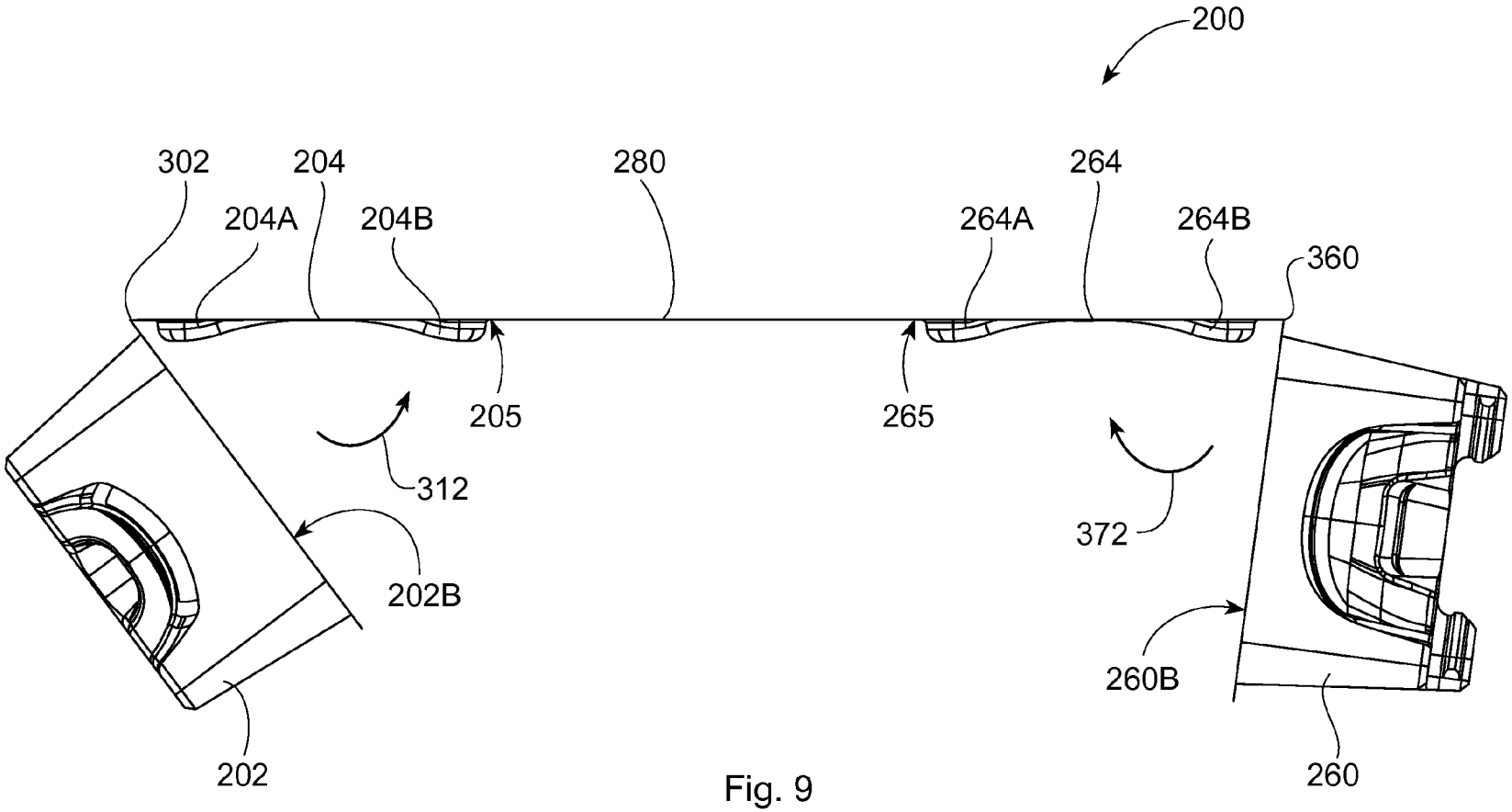
FIG. 9 shows an end view of a partially folded transparent module according to an embodiment of the present invention.

As stated previously the first section 202 may be folded with respect to the first section cover 204 which may be folded with respect to the eccentric cover 280 along the individual fold lines 302, 308. And, the second section 260 may be folded with respect to the second section cover 264 which may be folded with respect to the eccentric cover 280 along the individual fold lines 310, 360. Referring to FIG. 9, the first section 202 may be folded along the first folding line 302 which extends between the first section 202 and the first section cover 204. The first section 202 may be folded in a first counter-clockwise direction as shown by arrow 312, in FIGS. 8 and 9, about the first folding line 302. When the fold of the first section 202 is completed, a front face 205 of the first section cover 204 engages a back surface 202B of the first section 202.

The first section cover 204 may comprise at least one detent 204A, 204B, which can engage an interior surface of the first section 202 to form an interference fit and extend from the front face 205. These detents can be configured to provide some resistance to the separation of the first section 202 and the first section cover 204 once the first section 202 and the first section cover 204 are engaged with one another. Additional benefits of the detents 204A, 204B are discussed hereafter.

Referring to FIGS. 8 and 9, the detents 204A, 204B may extend any suitable length. In some embodiments, the detents 204A, 204B may extend from the first edge 290 to the second edge 292. In other embodiments, the detents 204A, 204B, may not extend from the first edge 290 to the second edge 292. In such embodiments, the detents 204A, 204B may be positioned in any suitable location, such as adjacent the first edge 290, adjacent the second edge 292, or equidistant between the first edge 290 and the second edge 292. Yet in further embodiments, a plurality of discrete detents may be utilized. For example, in some embodiments three or more detents may be utilized.

As shown in FIG. 9 and similar to the first section 202, the second section 260 may be folded along a second folding line 360 which extends between the second section 260 and the second section cover 264. As shown in FIGS. 8 and 9, the second section 260 may be folded in a first clockwise direction as shown by arrow 372 about the second folding line 360. When the fold of the second section 260 is completed, a front face 265 of the second section cover 264 engages a back surface 260B of the second section 260.

The second section cover 264 may comprise at least one detent 264A, 264B, which can engage an interior surface of the second section 260 and extend from the front face 265. These detents 264A and 265B can be configured as discussed heretofore with regard to the detents of the first section cover 204.

Figure 10:
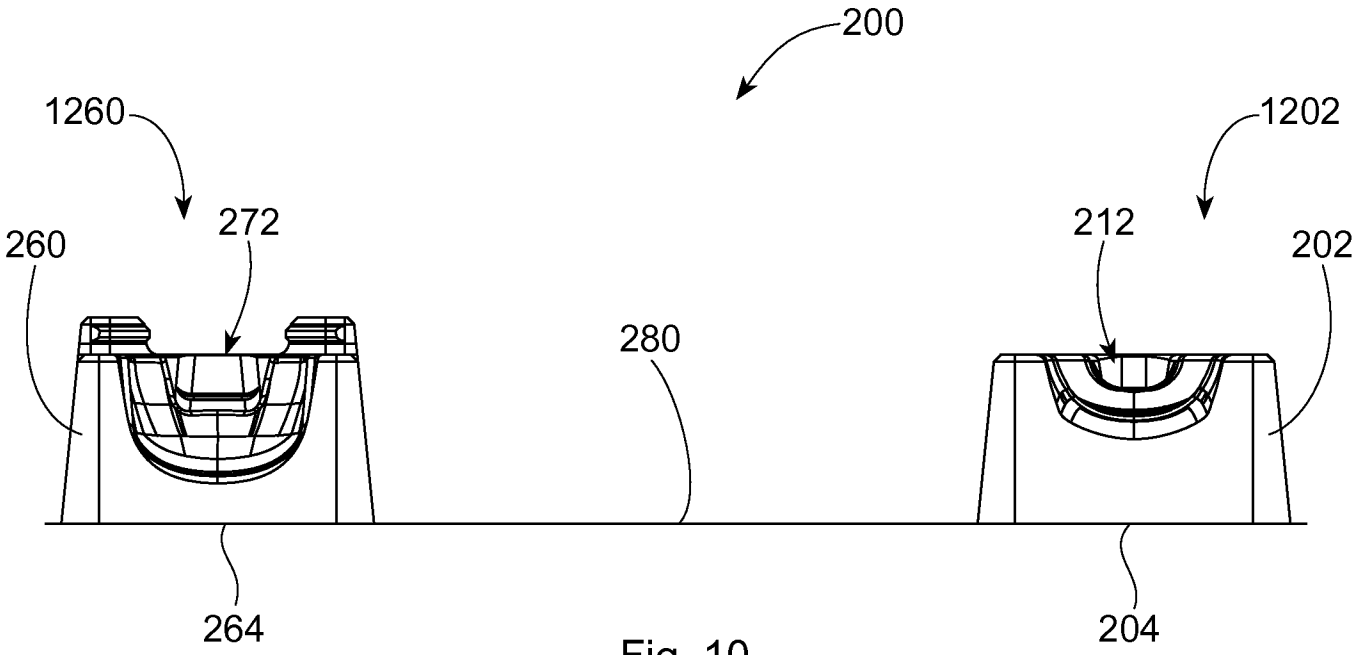
FIG. 10 shows an end view of a partially folded transparent module according to an embodiment of the present invention.

Regarding FIG. 10, the first section 202 and the second section 260 are shown after being folded such that each engages its respective cover. Once the first section 202 and the second section 260 are folded and engaged with their respect to their respective covers, a first portion 1202 and a second portion 1260 are created. At this point, an individual on an assembly line may place the personal article within a recess 212, 272 in the first portion 1202 or the second portion 1260. Alternatively, a machine could be utilize to place the personal article within one of the recesses.

Figure 11:
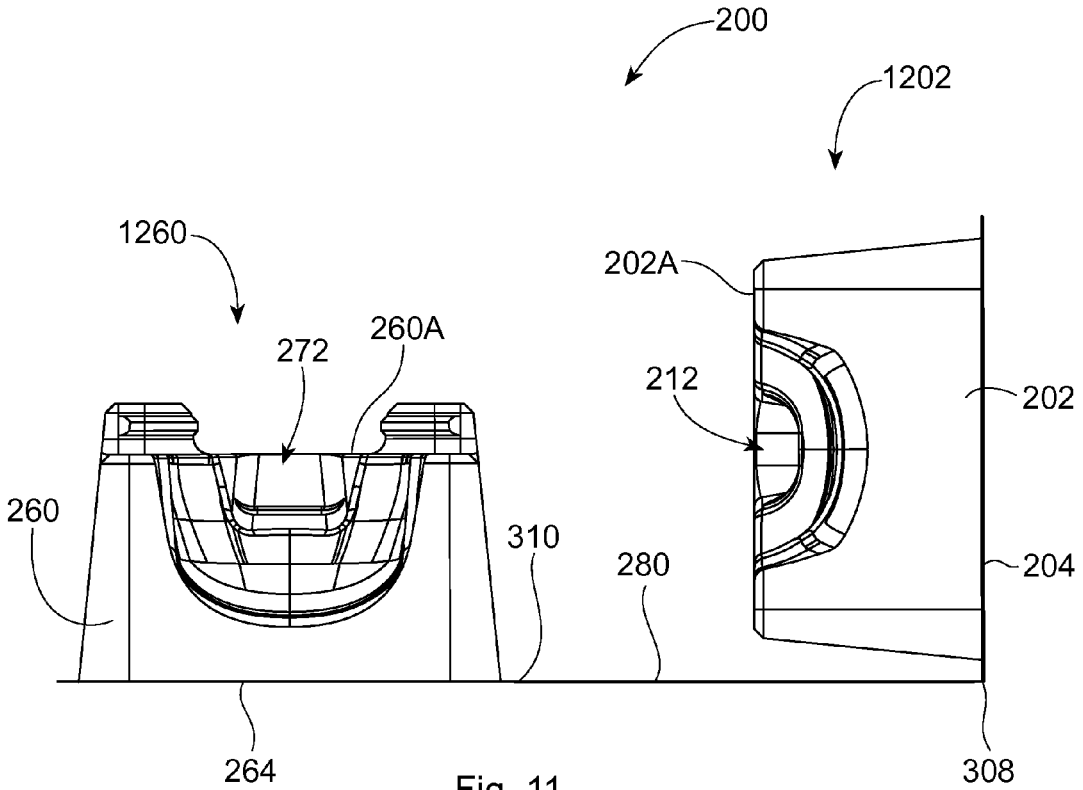
FIG. 11 shows an end view of a partially folded transparent module according to an embodiment of the present invention.

Referring to FIG. 11, if the personal article is placed in the recess 272 in the second section 260, then the first portion 1202 (including the first section 202 and the first section cover 204) may be folded along a third folding line 308. In contrast, if the personal article is placed in the recess 212, then the second portion 1260 (including the second section 260 and the second section cover 264) may be folded along a fourth folding line 310.

Figure 12:
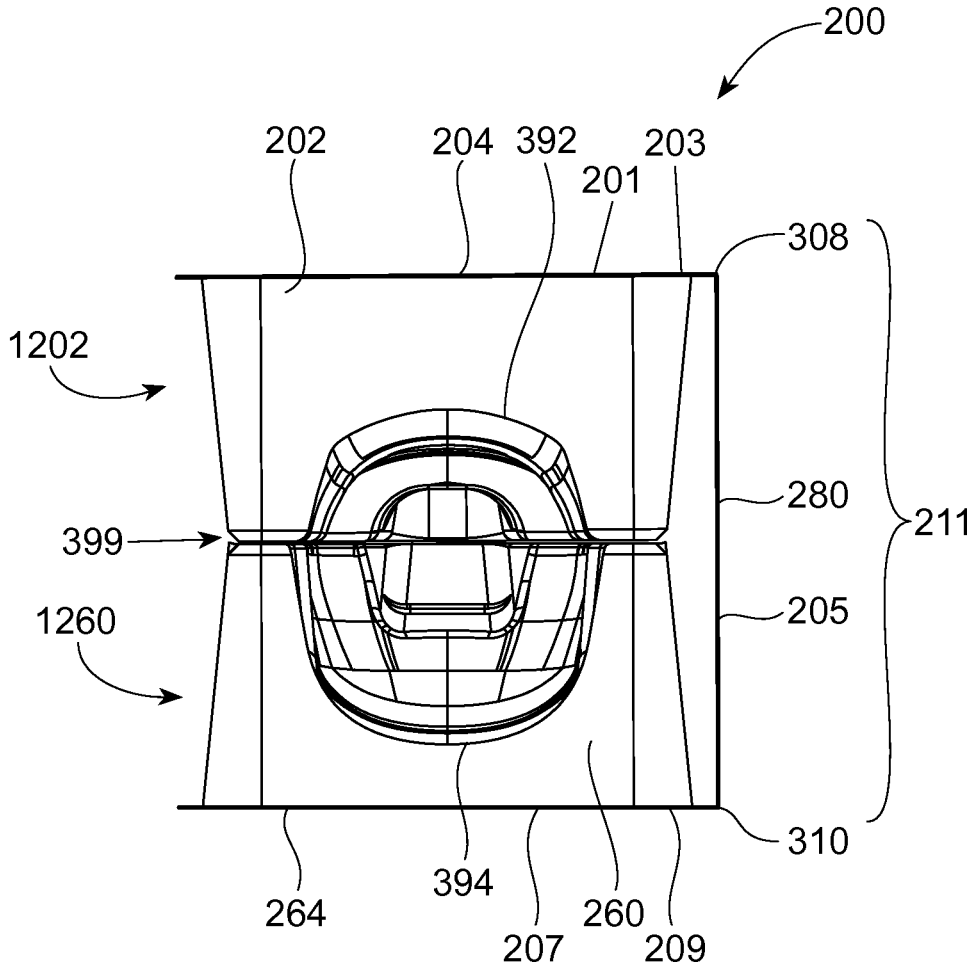
FIG. 12 shows an end view of a folded transparent module according to an embodiment of the present invention.

In order to completely enclose the personal article within the transparent module 200, the first portion 1202 (including the first section 202 and the first section cover 204) and the eccentric cover 280 may be folded about the fourth folding line 310 such that a front face 202A of the first section 202 is positioned adjacent a front face 260A of the second section 260, as shown in FIG. 12. In contrast, the second portion 1260 (including the second section 260 and the second section cover 264) and the eccentric cover 280 may be folded about the third folding line 308 such that the front face 202A of the first section 202 is positioned adjacent the front face 260A of the second section 260.

In the assembled state, the transparent module 200 protects the personal hygiene product with two layers/levels. First, the recess(es) in which the personal article is disposed is formed via a first outer shell 392 and a second outer shell 394. The first outer shell 392 and the second outer shell 394 may substantially surround the personal article such that the likelihood of contaminants coming into contact with the personal article is reduced. Second, the first section cover 204 provides protection to the first outer shell 392 while the second section cover 264 provides protection to the second outer shell 394. The first section cover 204 and the second section cover 264 can provide protection for the first outer shell 392 and the second outer shell 394, respectively, to reduce the likelihood of tampering with the first outer shell 392 or the second outer shell 394.

Referring to FIGS. 1 and 12, in the modular package 1, the transparent module 200 may be positioned such that the first section cover 204 or the second section cover 264 are positioned adjacent the window 5. The positioning of the first section cover 202 or the second section cover 264 adjacent the window can allow the consumer to visually perceive the personal article or a component thereof. For those embodiments, where the modular package 1 comprises a first window 5 and a second window opposite the first window 6, as shown in FIG. 1, the first section cover 204 and the second section cover 264 may be positioned adjacent the first window and the second window respectively. This can allow the consumer to view the personal article or component thereof from multiples sides, such as the front and back of the modular package. Embodiments are contemplated where the eccentric wall 280 is positioned adjacent the window 30. This orientation may allow the consumer to view a left or right side of the personal article. In such embodiments, a window opposite the window 30 may not be appropriate since a seam 399 would be exposed in the opposite window.

As discussed previously, the first section cover 204 and the second section cover 264 may comprise detents which facilitate the coupling to the first section 202 and the second section 260 respectively. Additionally, the creation of the detents on the first section cover 204 and the second section cover 264 can provide structural support for the first section cover 204 and the second section cover 264.

Figure 13:
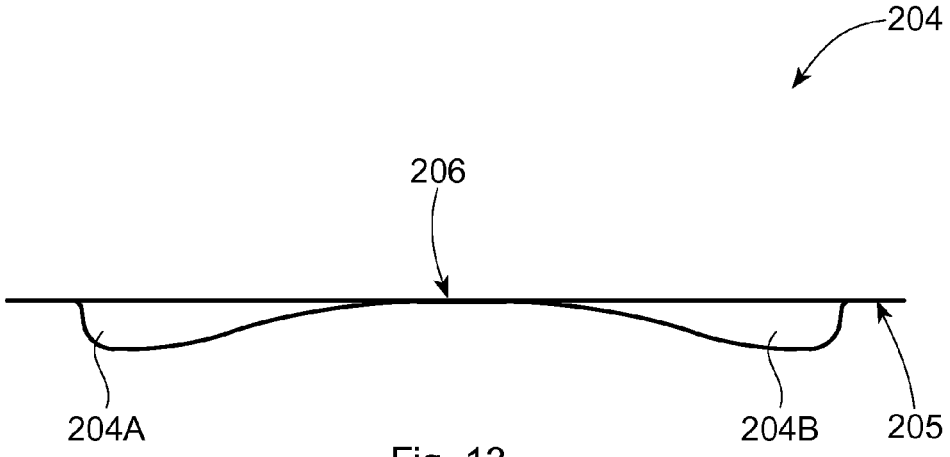
FIG. 13 shows a close-up view of a transparent module according to an embodiment of the present invention.

Referring to FIG. 13, the presence of detents 204A, 204B, can provide curvature to the front section cover 204. As discussed previously, the front face 205 of the first section cover 204 faces the first outer shell 392 (shown in FIG. 12) in the completely folded state. A back face 206, opposite the front face 205, may be positioned in the window 30 (shown in FIG. 1). Because the curvature of the first section cover 204 is convex when viewing from the back face 206, there is some structural support provided to the back face 206. The second section cover 264 may be similarly configured.

With reference back to FIGS. 8 and 12 the bottom edges 201, 203, 205, 207, 209 of the first section 202, first section cover 204, eccentric cover 280, second section cover 207, and second section when in the assembled state are substantially parallel forming a three-sided base 211, such that if the transparent module 200 were placed on a relatively flat surface the base would provide stability to the transparent module 200, such that the transparent module 200 could remain in an upright position. This free-standing capability allows the transparent module 200 to support, in upright position, personal articles which inherently are not capable of standing upright, such as a toothbrush. Personal articles, such as toothbrushes are normally incapable of remaining in an upright position absent some form of support. When, however, a personal article, such as a toothbrush is supported in the basic transparent module of the present invention, the transparent module serves to maintain the toothbrush in an upright position, thus enabling it to be displayed on a countertop or shelf surface. Further, the base 211 provides protection against the transparent module 200 being easily knocked over by in certain embodiments providing a tip angle of about 11%.

Embodiments are contemplated where the transparent module 200 may be utilized as a traveling case for a personal article. In such embodiments, the transparent module 200 may comprise a relesable snap feature, magnets, or a strap.

Figure 14:
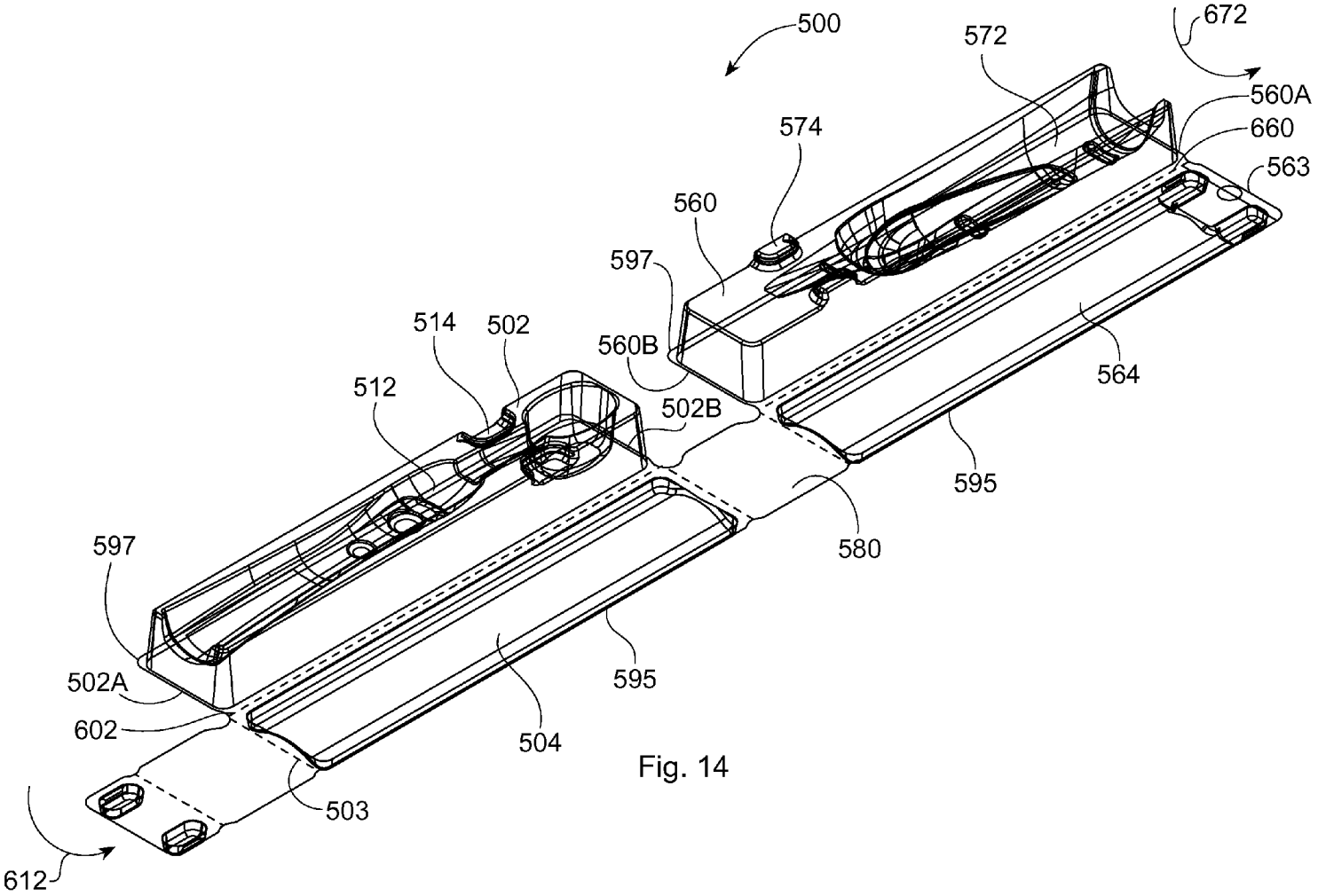
FIG. 14 shows a perspective view of an unfolded transparent module according to an embodiment of the present invention.

Referring to FIGS. 1, 1A and 14, another transparent module 500 for carrying a personal article may be utilized in the modular package 1. The transparent module 500 may comprise a transparent material, and can be positioned adjacent a window 5, the top 8, and the bottom 9 to allow the consumer to visually inspect/perceive the personal article. In some embodiments, the sleeve 4 may comprise a window 6 opposite the window 5 which can provide another view of the personal article to the consumer. In such embodiments, the transparent module 500 may comprise a transparent material adjacent this window in addition to the areas previously mentioned.

For ease of packaging, the transparent module 500 may comprise a plurality of sections which may be folded with respect to one another. As shown in FIG. 14, the transparent module 500 may comprise a first section 502 having a recess 512 therein for receiving a portion of the personal article. Adjacent the first section 502, a first section cover 504 may be positioned.

The transparent module 500 may comprise a second section 560 having a recess 572 therein for receiving a portion of the personal article. Adjacent the second section 560, a second section cover 564 may be positioned. Between the first section cover 504 and the second section cover 564, an eccentric cover 580 may be positioned.

As shown, the first section 502, the first section cover 504, the eccentric cover 580, the second section cover 564, and the second section 560 may be integrally joined with one another along hinged fold lines 602, 660. However, embodiments are contemplated where the first section 502, the first section cover 504, the eccentric cover 580, the second section cover 564, or the second section 560 are discrete from one another. For example, the first section 502 and the first section cover 504 may be integrally formed, and the second section 560 and the second section cover 564 may be integrally formed. In such embodiments the eccentric cover 580 may be discrete and attached to the first section 502, the second section 560, the first section cover 504, or the second section cover 564. Additionally, embodiments are contemplated where the transparent module 500 does not include the eccentric cover 580.

The first section 502 may comprise one or more receiving areas 514 while the second section 560 may include one or more engagement areas 574. When assembled, the outer surface of the engagement areas 574 may form an interference fit with the inner surface of the receiving areas 514 when brought into contact into contact by the folding of the first section 502 and second section 560. The interaction between the engagement areas 574 and the receiving areas 514 can help align the first section 502 and the second section 560. Additionally, the interference fit between the engagement areas 574 and the receiving areas 514 can provide some resistance to the separation of the first section 502 from the second section 560 thereby reducing the likelihood that the first section 502 and the second section 560 will separate inadvertently. Embodiments are contemplated where the first section 502 or the second section 560 comprise at least one engagement area 574 or at least one receiving area 514.

The engagement areas 574 or receiving areas 514 may be positioned in any suitable location. For example, engagement areas 574 or receiving areas 514 may be positioned adjacent a first edge 502A, 560A or adjacent a second edge 502B, 560B of the transparent module 500. As another example, the engagement areas 574 or receiving areas 514 may be positioned adjacent lateral edges 595 and 597. As yet another example, the engagement areas 574 or receiving areas 514 may be positioned adjacent the first edge 502A, 560A, the second edge 502B, 560B, or adjacent lateral edges 595 and 597.

Figure 15:
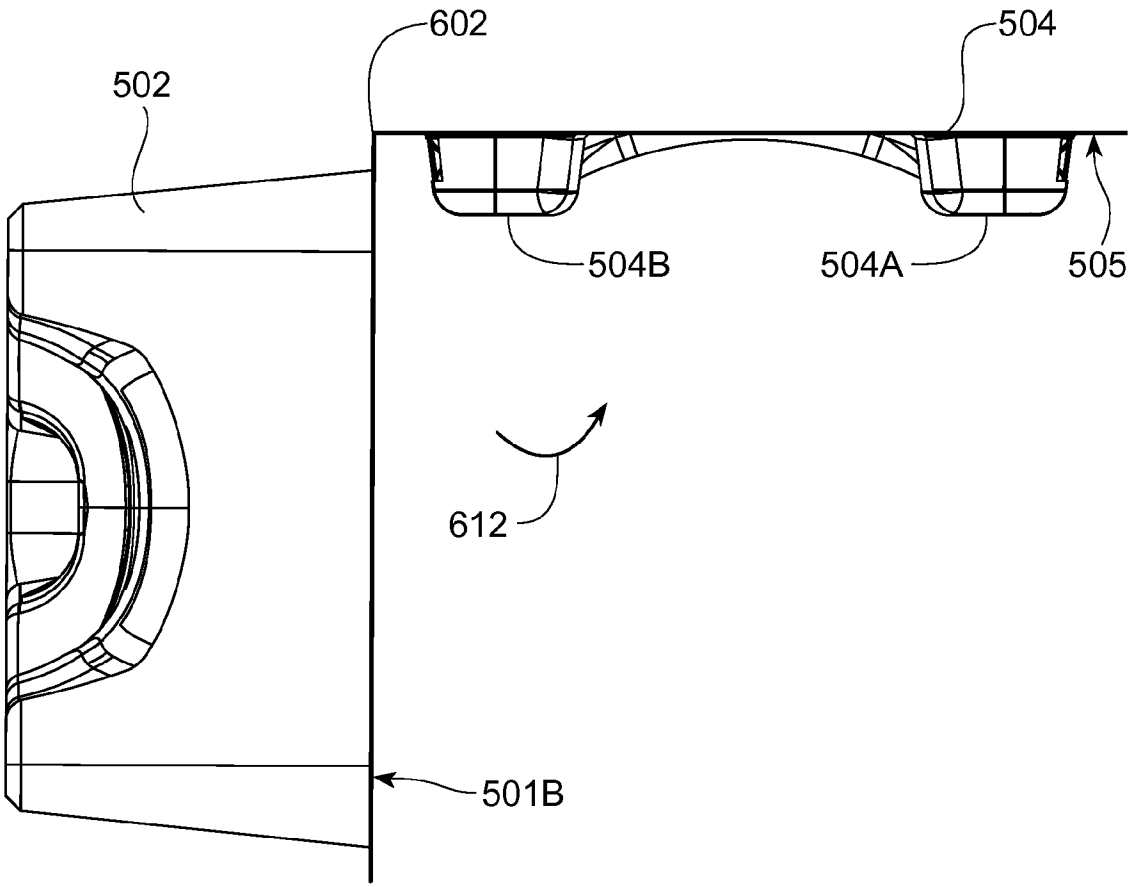
FIG. 15 shows an end view of a partially folded transparent module according to an embodiment of the present invention.

As stated previously the first section 502 may be folded with respect to the first section cover 504 which may be folded with respect to the eccentric cover 580. And, the second section 560 may be folded with respect to the second section cover 564 which may be folded with respect to the eccentric cover 580. Referring to FIG. 15, an elevation view of the transparent module is shown viewing the first section 502 from the first edge 502A toward the second edge 502B. The first section 502 may be folded along the first folding line 602 which extends between the first section 502 and the first section cover 504. As shown in FIGS. 14 and 15 the first section 502 may be folded in a first counter-clockwise direction as shown by arrow 612 about the first folding line 602. When the fold of the first section 502 is completed, a front face 505 of the first section cover 504 engages a back surface 501B of the first section 502.

The first section cover 504 may comprise at least one detent 504A, 504B, which can engage an interior surface of the first section 502 and extend from the front face 505. These detents can be configured to provide some resistance to the separation of the first section 502 and the first section cover 504 once the first section 502 and the first section cover 504 are engaged with one another. Additional benefits of the detents 504A, 504B are discussed hereafter.

Referring to FIGS. 14 and 15, the detents 504A, 504B may extend any suitable length. In some embodiments, the detents 504A, 504B may extend from the first edge 502A to the second edge 502B. In other embodiments, the detents 504A, 504B, may not extend from the first edge 502A to the second edge 502B. In such embodiments, the detents 504A, 504B may be positioned in any suitable location, for example adjacent the first edge 502A, adjacent the second edge 502B, or equidistant between the first edge 502A and the second edge 502B. Yet in further embodiments, a plurality of discrete detents may be utilized. For example, in some embodiments three or more detents may be utilized.

Figure 16:
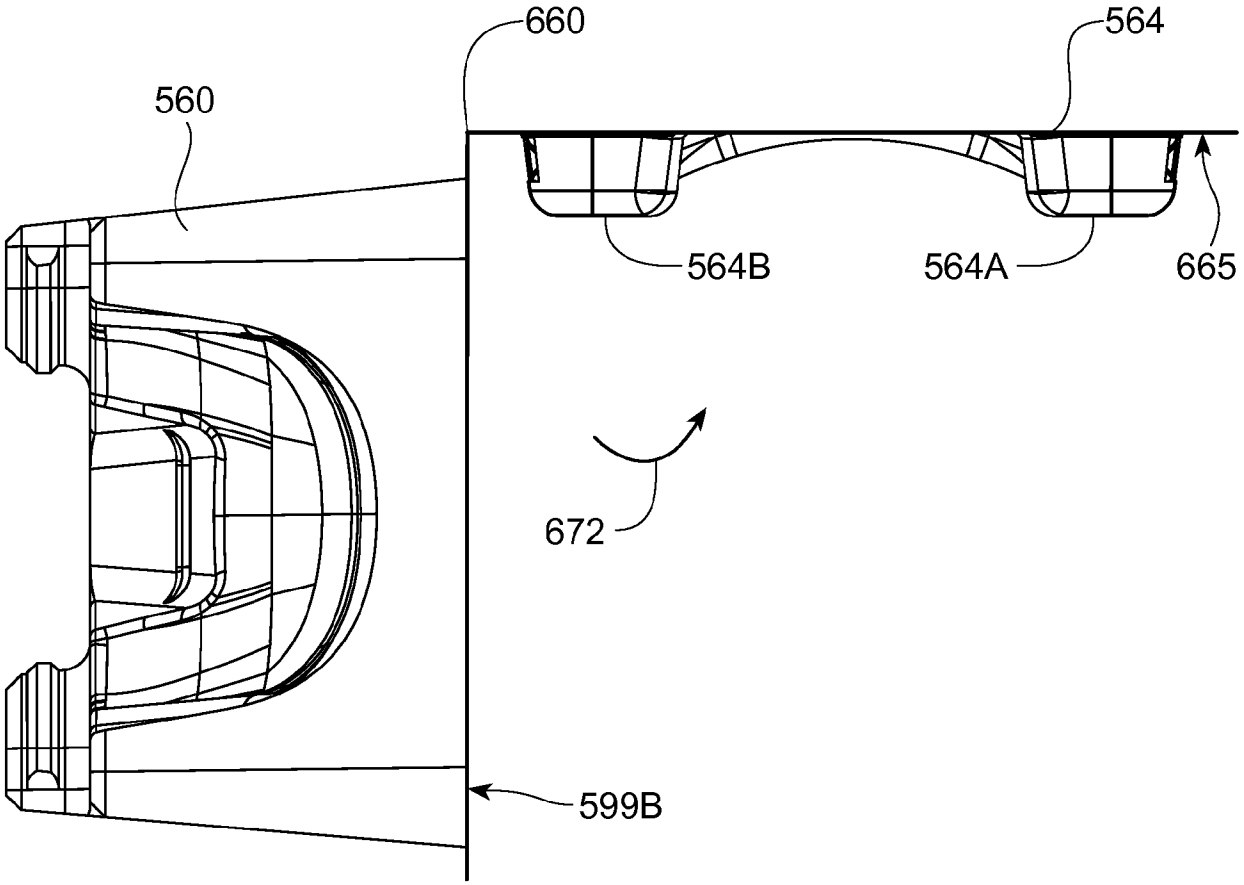
FIG. 16 shows an end view of a partially folded transparent module according to an embodiment of the present invention.

As shown in FIG. 16, an elevation view of the transparent module 500 is shown viewing the second section 560 from the first edge 560A toward the second edge 560B. Similar to the first section 502, the second section 560 may be folded along the second folding line 660 which extends between the second section 560 and the second section cover 564. The second section 560 may be folded in a second counter-clockwise direction as shown by arrow 672 about the second folding line 660. When the fold of the second section 560 is completed, a front face 665 of the second section cover 664 engages a back surface 599B of the second section 560.

The second section cover 564 may comprise at least one detent 564A, 564B, which can engage an interior surface of the second section 560 and extend from the front face 665. These detents 564A and 565B can be configured as discussed previously with regard to the detents of the first section cover 504, 204.

Figure 17:
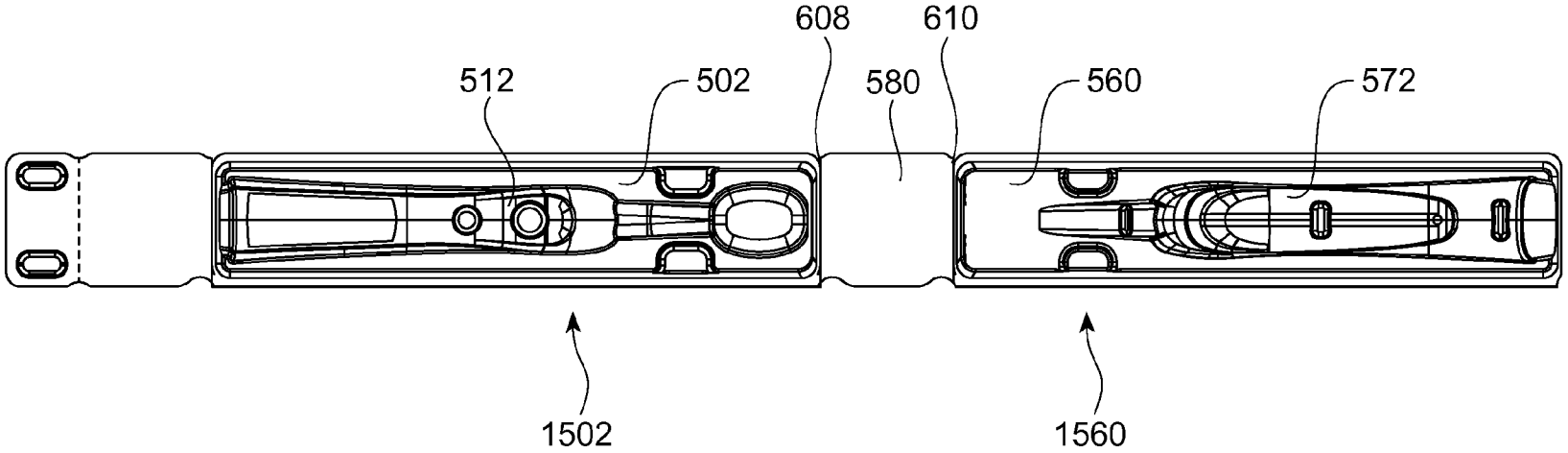
FIG. 17 shows an elevated view of a partially folded transparent module according to an embodiment of the present invention.

Regarding FIG. 17, the first section 502 and the second section 560 are shown after being folded such that each engages its respective cover. Once the first section 502 and the second section 560 are folded and engaged with their respective covers, a first portion 1502 and a second portion 1560 are created. At this point, an individual on an assembly line may place the personal article within a recess 512, 572 in the first portion 1502 or the second portion 1560. Alternatively, a machine could be utilized to place the personal article within one of the recesses.

Figure 18:
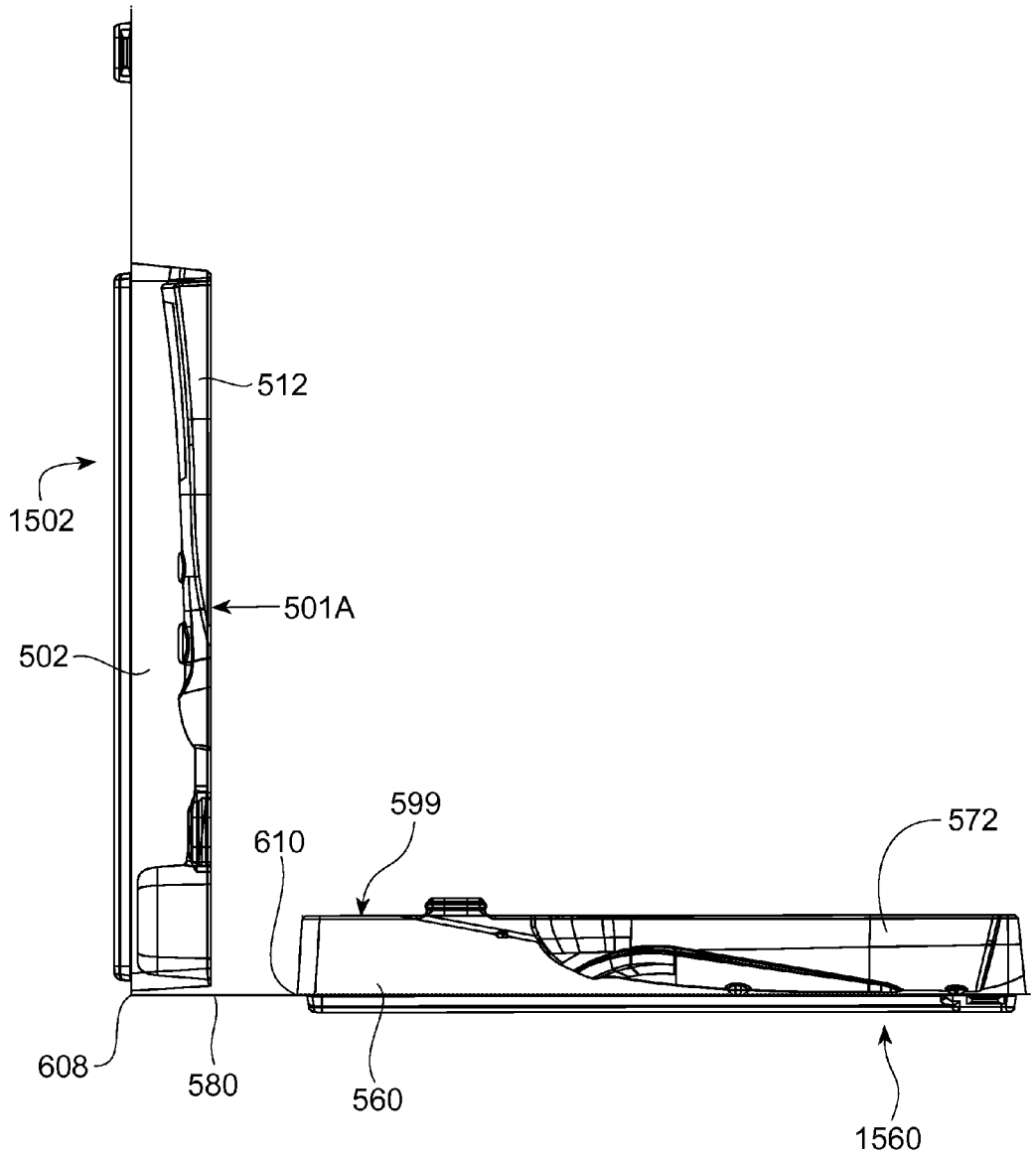
FIG. 18 shows a side view of a partially folded transparent module according to an embodiment of the present invention.
Figure 19:
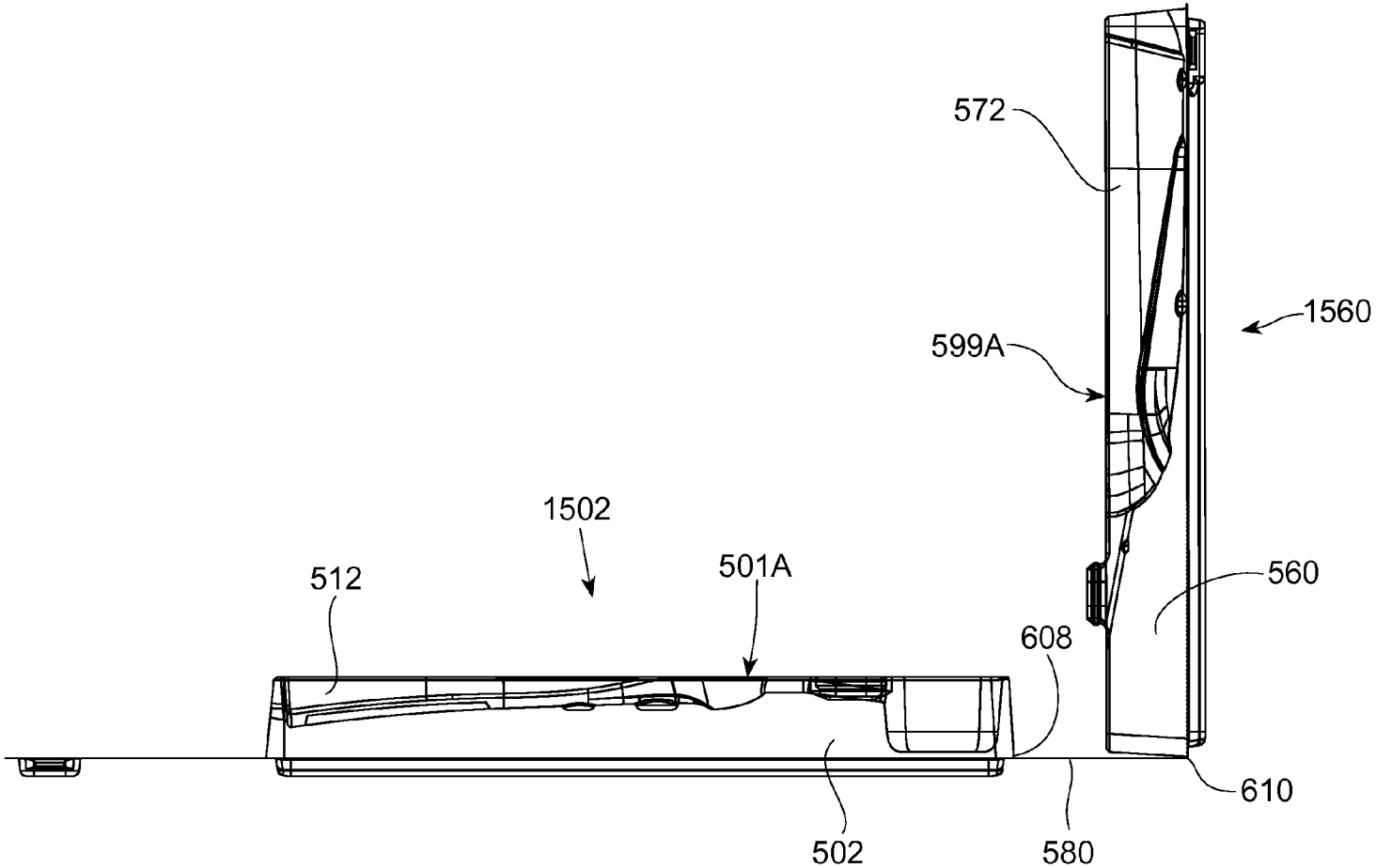
FIG. 19 shows a side view of a partially folded transparent module according to an embodiment of the present invention.

Referring to FIGS. 17, 18 and 19, if the personal article is placed in the recess 572 in the second section 560, then the first portion 1502 (including the first section 502 and the first section cover 504) may be folded along a third folding line 608. In contrast, if the personal article is placed in the recess 512, then the second portion 1260 (including the second section 560 and the second section cover 564) may be folded along a fourth folding line 610.

In order to completely enclose the personal article within the transparent module 500, the first portion 1502 (including the first section 502 and the first section cover 504) and the eccentric cover 580 may be folded about the fourth folding line 610 such that a front face 501A of the first section 502 is positioned adjacent a front face 599A of the second section 560. In contrast, the second portion 1560 (including the second section 560 and the second section cover 564) and the eccentric cover 580 may be folded about the third folding line 608 such that the front face 501A of the first section 502 is positioned adjacent the front face 599A of the second section 560.

Figure 20:
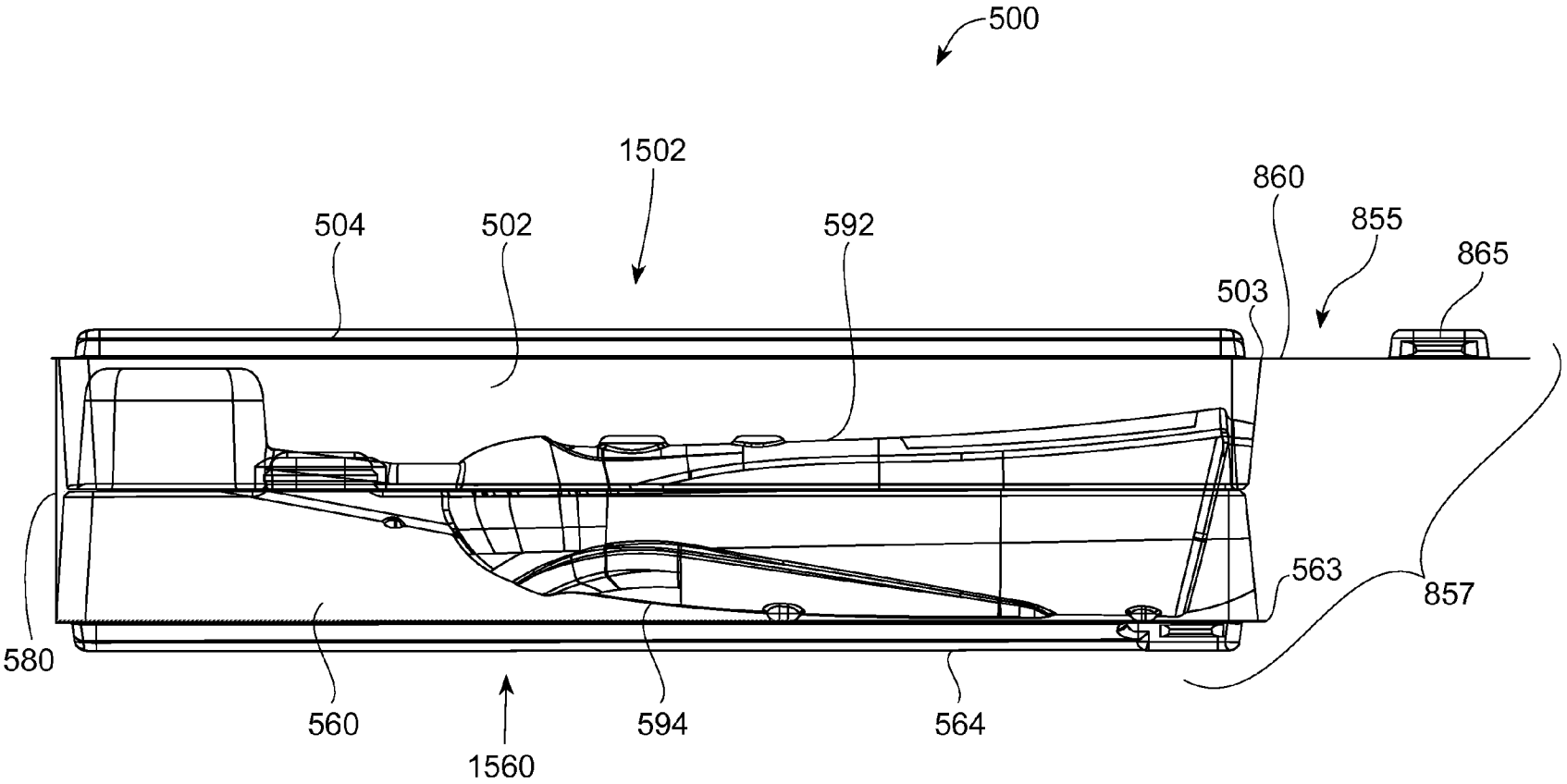
FIG. 20 shows a side view of a partially folded transparent module according to an embodiment of the present invention.

When the first portion 1502 and the second portion 1560 are engaged, a locking mechanism 855 may engage the second portion 1560 as shown in FIG. 20. The locking mechanism 855 may comprise an extension portion 860 and a receiving portion 865 which can engage a corresponding engagement portion on the second portion 1560. In some embodiments, the receiving portion 865 may comprise detents and the engagement portion may comprise corresponding recesses for receiving the detents or vice versa or combinations thereof.

As shown, the locking mechanism 855 may extend from the first section cover 504 (shown in FIG. 14). Alternatively, the locking mechanism 855 may extend from the first section 502. The locking mechanism 855 may be discrete and attached to the first section 502 or the first section cover 504. Alternatively, the locking mechanism 855 may be integrally formed with the first section 502 or the first section cover 504.

In other embodiments, the locking mechanism 855 may extend from the second portion 560 or the second portion cover 564 (shown in FIG. 14). In such embodiments, the locking mechanism 855 may engage the first portion 1502 as described heretofore with regard to the engagement between the locking mechanism and the second portion 1560.

Figure 21:
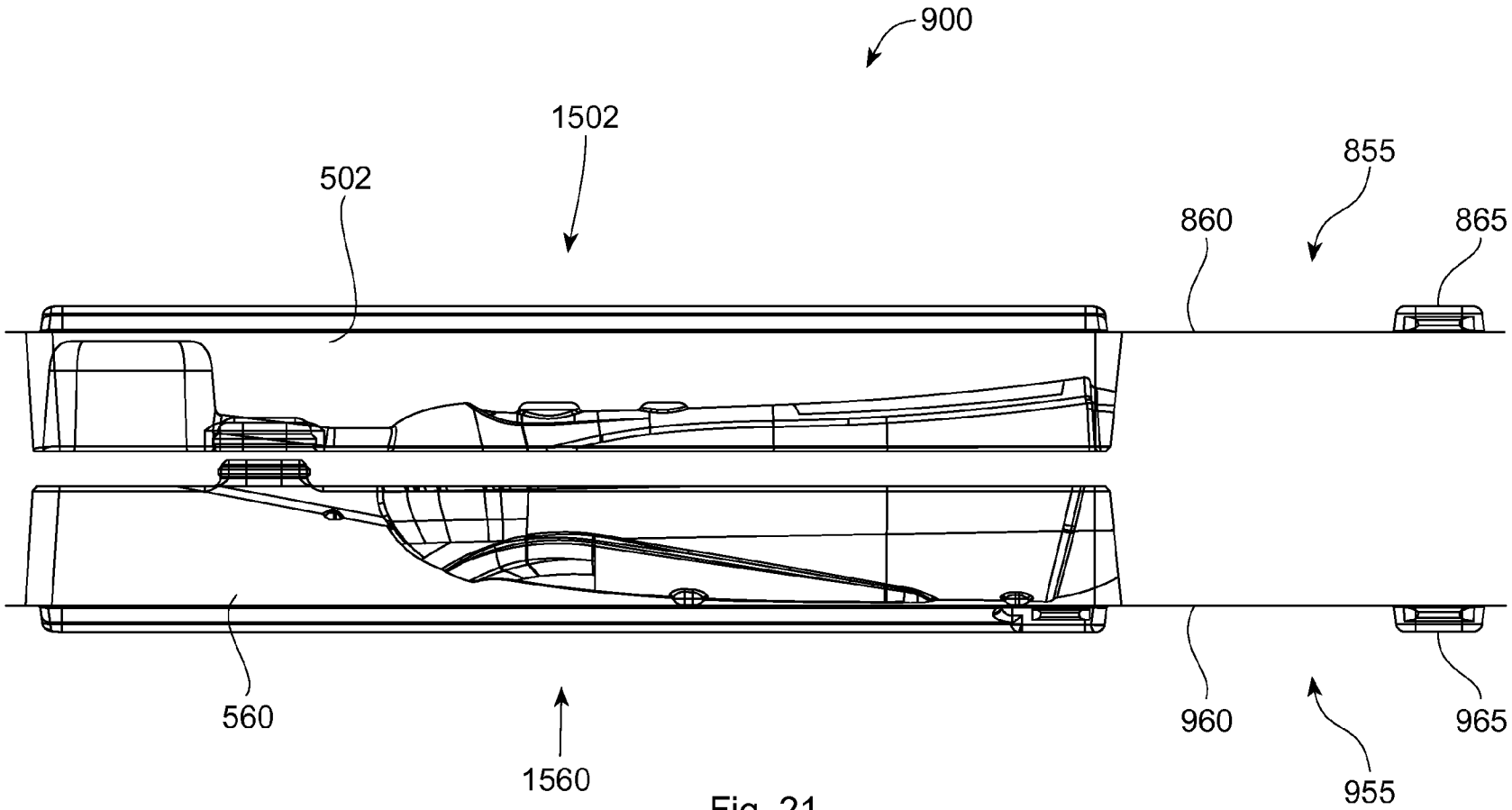
FIG. 21 shows a side view of a partially folded transparent module according to an embodiment of the present invention.

Still in other embodiments, referring to FIG. 21, for a module 900, the first portion 1502 or the second portion 1560 may comprise the locking mechanism 855 as described above. The other of the first portion 1502 or the second portion 1560 may comprise a receiving element 955 which is meant to engage the locking mechanism 855. The receiving element 955 may comprise an extension portion 960 and a receiving portion 965. Embodiments are contemplated where the transparent module 200 comprises a locking mechanism 865 or a receiving element 955 as described heretofore.

Referring to FIGS. 20 and 21, in the assembled state, the transparent module 500, 900 protects the personal article with two layers/levels. First, the recess(es) in which the personal article is disposed is formed via a first outer shell 592 and a second outer shell 594. The first outer shell 592 and the second outer shell 594 may substantially surround the personal article such that the likelihood of contaminants coming into contact with the personal article is reduced. Second, the first section cover 504 provides protection to the first outer shell 592 while the second section cover 564 provides protection to the second outer shell 594. The first section cover 504 and the second section cover 564 can provide protection for the first outer shell 592 and the second outer shell 594, respectively, to reduce the likelihood of tampering with the first outer shell 592 or the second outer shell 594.

Referring to FIGS. 1, 1A and 20, in the on store shelf modular package 1, the transparent module 500, 900 may be positioned such that the first section cover 502 or the second section cover 564 are positioned adjacent the window 5. The positioning of the first section cover 502 or the second section cover 564 adjacent the window 5 can allow the consumer to visually perceive the personal article or a component thereof. For those embodiments, as shown in FIG. 1 where the modular package 1 comprises a first window 5 and a second window 6 opposite the first window, the first section cover 504 and the second section cover 564 may be positioned adjacent the first window 5 and the second window 6 respectively. This can allow the consumer to view the personal article or component thereof from multiples sides, such as front and back. Embodiments are contemplated where the eccentric wall 580 is positioned adjacent the window 5. This orientation may allow the consumer to view a left or right side of the personal article.

As discussed previously, the first section cover 504 and the second section cover 564 may comprise detents which facilitate the coupling to the first section 502 and the second section 560 respectively. Additionally, the creation of the detents on the first section cover 504 and the second section cover 564 can provide structural support for the first section cover 504 and the second section cover 564. The detents 504A, 504B, 564A, and 564B, may be configured similarly to the detents described heretofore, e.g. 204A, 204B.

With reference to FIGS. 14 and 20 the bottom edges 503, 563 of the first section cover 505 and second section cover 564 when in the assembled state form a base 857 in combination with the locking mechanism 855, which provides a substantially flat platform that connects the bottom edges 503, 563 of the first section cover 505 and second section cover 564. The base 857 provides stability to the transparent module 500, such that if the transparent module 500 were placed on a relatively flat surface the transparent module 500 could remain in an upright position, as described previously with reference to transparent module 200.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A modular package comprising:

a top surface, bottom surface, and side surface;

a container encompassing a first module and a second transparent module, wherein the container comprises a window through which a personal article is visible to a consumer;

the first module having three pairs of opposing panels defining an interior space;

each panel having an exterior and interior surface;

a top and base panel forming one pair of opposing panels;

side panels forming two pairs of opposing panels;

one of the side panels being a flap connected to an adjacent side panel by a fold line for forward and backward movement, allowing access to the interior space of the first module;

the second transparent module comprising a personal article, wherein the personal article is visible to a consumer;

wherein the second transparent module comprises;

a first section having a receiving area, a front face and a back surface and a first recess portion therein;

a first section cover disposed adjacent to the first section and being formed integrally with the first section, the first section cover having a detent, a front face and a back face;

a first fold line disposed between the first section and the first section cover allowing the front face of the first section cover to engage the back face of the first section;

a second section having an engagement area, a front face and a back surface and a second recess portion therein;

a second section cover disposed adjacent to the second section and being formed integrally with the second section, the second section cover having a detent, and a front face;

a second fold line disposed between the second section and the second section cover allowing the front face of the second section cover to engage the back face of the second section;

an eccentric cover configured to allow the first section and the first section cover to be folded with respect to the second section and the second section cover, the eccentric cover being disposed between the first section and the section or between the first section cover and the second section cover.

2. The modular package of claim 1 wherein the container is at least one of a box or a sleeve.

3. The modular package of claim 1 wherein the personal article is at least one of powered razors, manual razors, powered toothbrushes, powered toothbrush components, powered toothbrush accessories, manual toothbrushes, floss, rinses, shampoos, conditioners, or lotions.

4. The modular package of claim 1, wherein the transparent module is comprised of transparent plastic.

5. The modular package of claim 4, wherein the plastic is at least one of ethylene, propylene, butene, butadiene, polystyrenes, acetates, butyrates, propionates or vinyls.

* * * * *